US008366095B2

(12) United States Patent
Urano et al.

(10) Patent No.: US 8,366,095 B2
(45) Date of Patent: Feb. 5, 2013

(54) SHEET POST-PROCESSING APPARATUS AND IMAGE FORMING APPARATUS

(75) Inventors: Yuri Urano, Toride (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 12/962,238

(22) Filed: Dec. 7, 2010

(65) Prior Publication Data

US 2011/0140348 A1 Jun. 16, 2011

(30) Foreign Application Priority Data

Dec. 10, 2009 (JP) ..... 2009-281002

(51) Int. Cl.
*B65H 37/06* (2006.01)

(52) U.S. Cl. ..... 270/58.1; 270/32; 270/45; 271/273; 271/198; 271/278

(58) Field of Classification Search ..... 270/58.08, 270/58.1, 32, 45; 271/198, 200, 314, 273, 271/278
See application file for complete search history.

(56) References Cited

U.S. PATENT DOCUMENTS 5,288,062 A * 2/1994 Rizzolo et al. ..... 270/58.12
6,273,418 B1 * 8/2001 Fujikura et al. ..... 271/228
7,631,859 B2 * 12/2009 Milillo et al. ..... 270/58.07
7,857,300 B2 * 12/2010 Moore et al. ..... 270/58.11
7,871,066 B2 * 1/2011 Kodama et al. ..... 270/58.12
7,954,801 B2 * 6/2011 Fukami ..... 270/58.11
7,976,004 B2 * 7/2011 Kimura ..... 270/58.11
8,104,759 B2 * 1/2012 Kawaguchi ..... 270/58.12
2005/0258585 A1 * 11/2005 Reeves et al. ..... 270/58.08
2009/0072476 A1 * 3/2009 Inoue et al. ..... 271/273
2010/0289205 A1 * 11/2010 Taki ..... 270/58.08

FOREIGN PATENT DOCUMENTS

JP 09-278267 A 10/1997

* cited by examiner

*Primary Examiner* — Patrick Mackey
(74) *Attorney, Agent, or Firm* — Canon USA Inc. IP Division

(57) ABSTRACT

A sheet post-processing apparatus includes a discharge portion configured to discharge a sheet having a folding portion, a conveyance portion configured to abut on a lower surface of the sheet discharged by the discharge portion, to convey the sheet downstream in a sheet conveyance direction of the discharge portion, a pressing portion arranged at a position opposing the conveyance portion, configured to press an upper surface of the sheet discharged by the discharge portion, and a moving portion configured to move the pressing portion in the sheet conveyance direction of the conveyance portion, in which the moving portion moves the pressing portion upstream in the sheet conveyance direction of the conveyance portion, to move the pressing portion from a position where the sheet discharged by the discharge portion is not pressed to a position where the sheet discharged by the discharge portion is pressed.

10 Claims, 18 Drawing Sheets

SHEET POST-PROCESSING APPARATUS AND IMAGE FORMING APPARATUS

BACKGROUND OF THE INVENTION

1. Field of the Invention

The present invention relates to a sheet post-processing apparatus that is provided in an image forming apparatus for imbricately stacking sheets folded in two.

2. Description of the Related Art

Conventionally, in sheet post-processing apparatuses for stacking sheet bundles that have been saddle-stitched by a saddle stitch binding machine, many sheet post-processing apparatuses in which the sheet bundles are stacked with their folded end portions positioned downstream in a conveyance direction are discussed.

Such a sheet post-processing apparatus performs operations, as described below, to stack sheet bundles.

A discharge roller discharges a sheet bundle discharged by the discharge roller onto a conveyer belt. The conveyer belt moves the discharged sheet bundle by a predetermined amount so that a folded end portion of the discharged sheet bundle is positioned downstream in a conveyance direction of a folded end portion of a sheet bundle to be subsequently discharged. An upstream end portion (an open end portion) in the conveyance direction of the discharged sheet bundle is positioned at the bottom of a downstream end portion (a folded end portion) in the conveyance direction of the sheet bundle to be subsequently discharged.

When the sheet bundle to be subsequently discharged is discharged onto the discharged sheet bundle, the conveyer belt moves the subsequently discharged sheet by a predetermined amount downstream in preparation for discharge of a sheet bundle to be subsequently discharged. The foregoing operations are repeated so that sheet bundles discharged onto the conveyer belt are stacked with a downstream end portion in the conveyance direction of the sheet bundle overlapping with the top of an upstream end portion in the conveyance direction of the preceding sheet bundle, i.e., so-called "imbricately", as illustrated in FIG. 17.

The sheet bundles are thus imbricately stacked for the following reason. A conventional sheet post-processing apparatus includes a stacking portion for stacking sheet bundles conveyed by a conveyer belt downstream of the conveyer belt. The reason comes from that if the length of the conveyer belt is made longer to provide a function of stacking sheet bundles for the purpose of increasing a stacking amount of the sheet bundles, the sheet post-processing apparatus grows in size.

As illustrated in FIGS. 18A and 18B, sheet bundles conveyed by a conveyer belt 750 move to a stacking portion 752 and thereby they do not receive a conveyance force from the conveyer belt 750. If the conveyer belt 750 conveys sheet bundles not imbricately, as illustrated in FIG. 18A, a folded end portion of the sheet bundle may enter an open end portion of the sheet bundle previously discharged in the stacking portion 752 to damage the open end portion, as illustrated in FIG. 18B. Even when the folded end portion of the sheet bundle does not enter the open end portion of the preceding sheet bundle, if the sheet bundle abuts on the open end of the preceding sheet bundle from a upstream side in a conveyance direction, the sheet bundle may push the preceding sheet bundle, thereby the position of the preceding sheet bundle is disarranged. However, the above-mentioned problem can be resolved by stacking the sheet bundles imbricately. Further, a stacking amount of the sheet bundles can also be increased by stacking the sheet bundles imbricately.

Such a sheet post-processing apparatus includes the conveyer belt 750 for conveying a sheet bundle discharged by a discharge roller from a downstream side in the conveyance direction, and a pressing roller 751 for pressing an upper surface of the sheet bundle on the conveyer belt 750, as illustrated in FIGS. 18A and 18B (Japanese Patent Application Laid-Open No. 09-278267).

The pressing roller 751 abuts on the conveyer belt 750 to form a nip portion, to which the sheet bundle thrusts into. The pressing roller 751 strengthens folding at a folded end of the sheet bundle while suppressing opening of an open end portion of the sheet bundle, to stack easily succeeding sheet bundles on the preceding sheet bundle, and applies a conveyance force of the conveyer belt 750 to the sheet bundles.

However, when the thickness of the sheet bundle is increased due to effects caused by, for example, the type of sheets, the grammage, or the number of sheets in the conventional sheet post-processing apparatus, it becomes difficult for the sheet bundle to thrust into the nip portion of the pressing roller 751 while a downstream end portion in the conveyance direction of the sheet bundle is overlapping with the preceding sheet bundle. It is because the sheet bundle conveyed by the conveyer belt 750 is stacked on the preceding sheet bundle and the conveyer belt 750 until it is pressed by the pressing roller 751. Therefore, the sheet bundle receives only a conveyance force generated by friction and does not receive a sufficient conveyance force until it thrusts into the nip portion. Moreover, another reason is that in the case of the sheet bundle with a large thickness, a load for the sheet bundle to thrust into the nip portion of the pressing roller 751 is increased. Therefore, if the succeeding sheet bundle cannot thrust into the nip portion only a preceding sheet bundle FT is conveyed downstream (refer to FIG. 18). After imbricate stacking is broken up, the succeeding sheet bundle, when it is conveyed downstream, may enter an open end portion of the preceding sheet bundle FT, which has passed through the conveyer belt 750, on a downstream side in the conveyance direction (refer to FIG. 18B).

In the conventional sheet post-processing apparatus, when the length of the conveyer belt 750 is made longer, and the above-mentioned stacking portion is not provided, the succeeding sheet bundle does not enter the open end portion of the preceding sheet bundle FT even if the sheet bundles are not imbricately stacked. However, when a thick sheet bundle folded in two or a thick sheet bundle even if it has no bending portion, is conveyed, the sheet bundle may be unable to thrust into the nip portion of the pressing roller 751.

SUMMARY OF THE INVENTION

The present invention is directed to providing a sheet post-processing apparatus that enables a pressing portion to press a sheet having a folding portion by preventing the pressing portion from stopping conveying of the sheet.

According to an aspect of the present invention, a sheet post-processing apparatus includes a discharge portion configured to discharge a sheet, a conveyance portion configured to abut on a lower surface of the sheet discharged by the discharge portion, to convey the sheet downstream in a sheet conveyance direction of the discharge portion, a pressing portion arranged at a position opposing the conveyance portion, configured to press an upper surface of the sheet discharged by the discharge portion, and a moving portion configured to move the pressing portion in the sheet conveyance direction of the conveyance portion, in which the moving portion moves the pressing portion upstream in the sheet conveyance direction of the conveyance portion, to move the pressing portion from a position where the sheet discharged by the discharge portion is not pressed, to a position where the sheet discharged by the discharge portion is pressed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
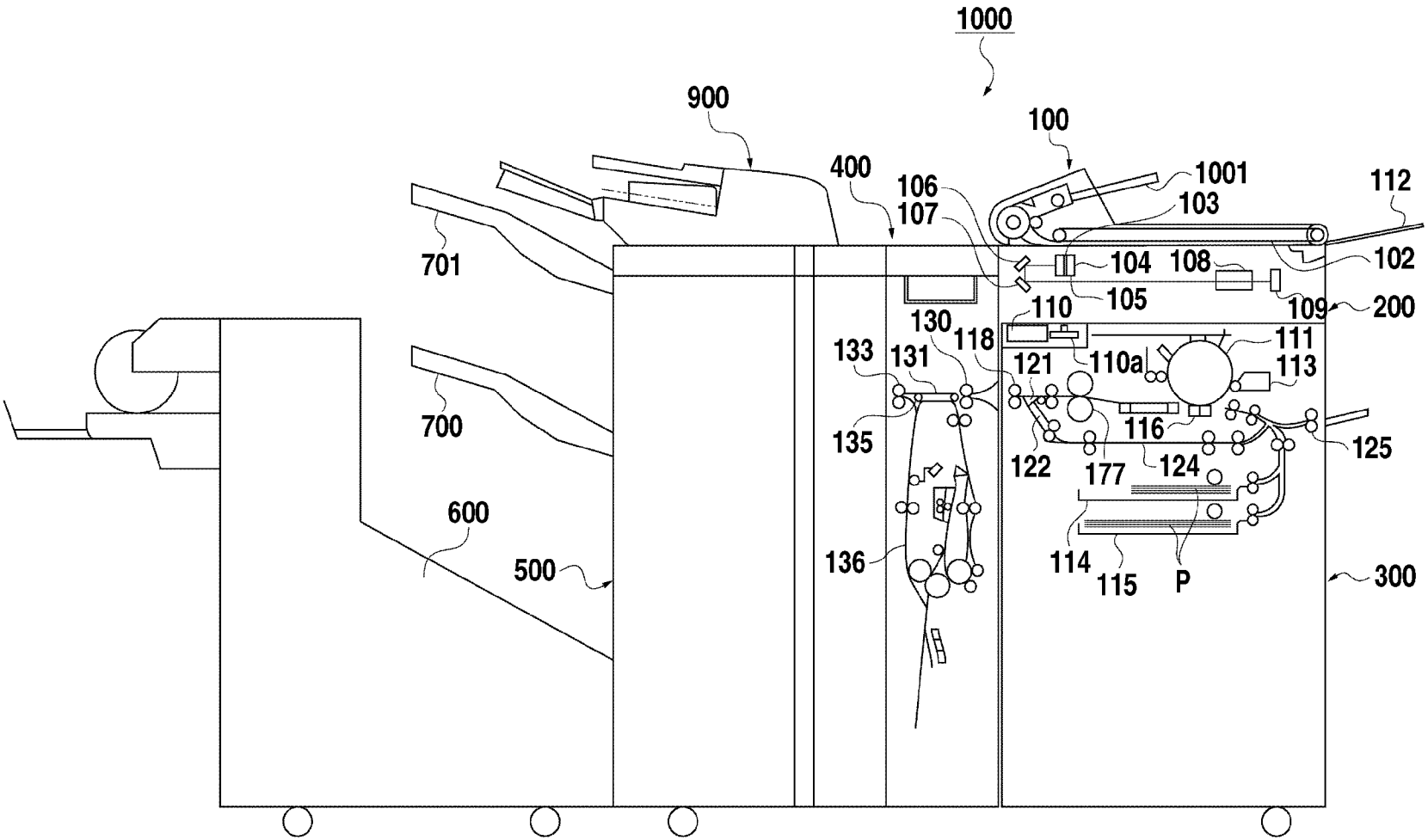
FIG. 1 is a cross-sectional view of an image forming apparatus including a sheet post-processing apparatus according to a first exemplary embodiment of the present invention.
Figure 2:
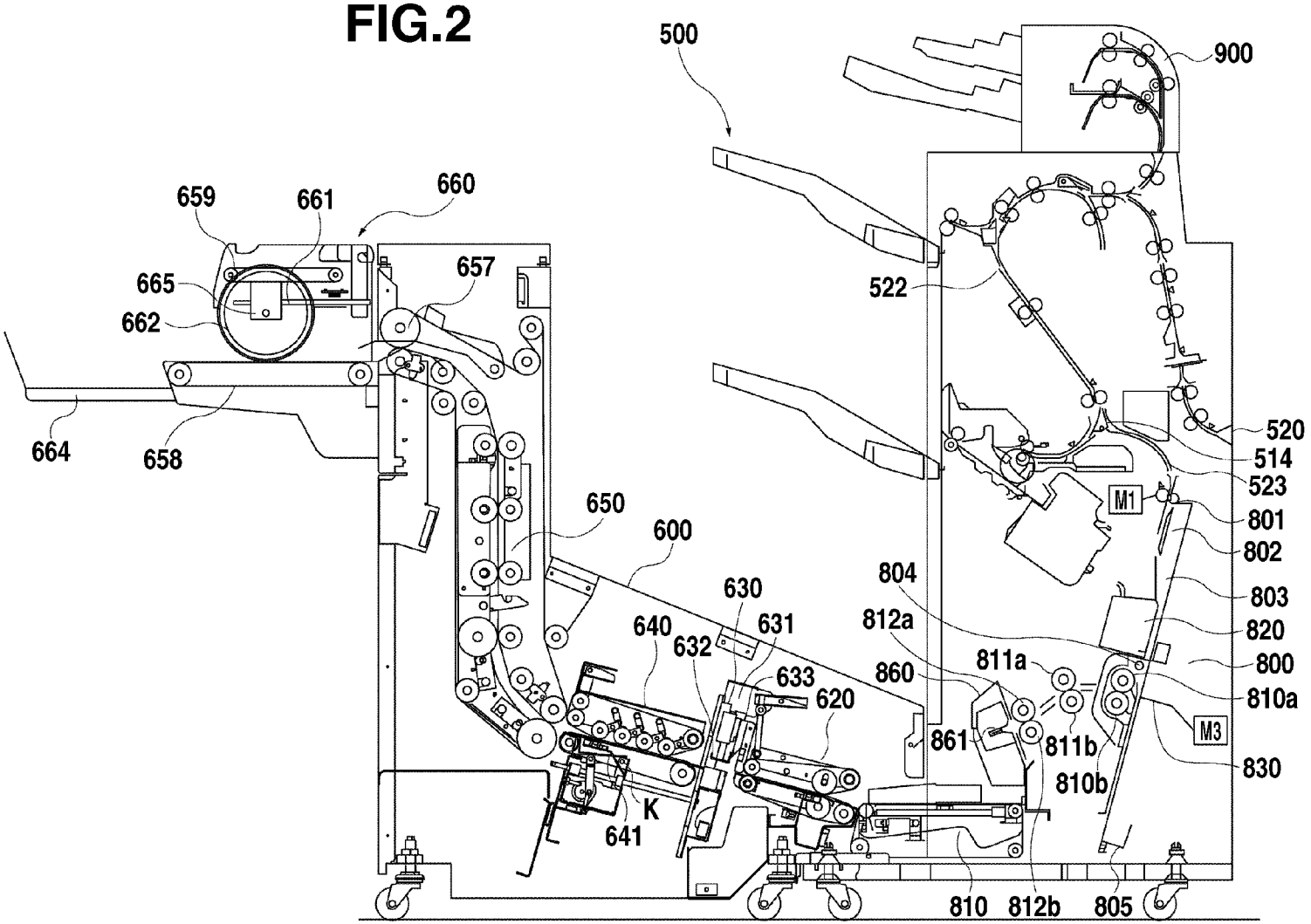
FIG. 2 is a cross-sectional view of the sheet post-processing apparatus.

A schematic configuration of an image forming apparatus including a sheet post-processing apparatus will be described with reference to FIGS. 1 and 2. FIG. 1 is a cross-sectional view illustrating an example of an internal configuration of the image forming apparatus. FIG. 2 is a cross-sectional view illustrating an example of an internal configuration of the sheet post-processing apparatus. A copying machine is illustrated as an example of the image forming apparatus in the figures.

As illustrated in FIG. 1, a copying machine 1000 according to a first exemplary embodiment includes a document feeding portion 100, an image reader portion 200, a printer portion 300, a folding processing portion 400, a finisher 500, a trimmer portion 600, a saddle stitch binding portion 800, an inserter 900, and so on. The folding processing portion 400, the saddle stitch binding portion 800, the inserter 900, and so on can be provided as optional extras. The foregoing will be specifically described below.

In FIG. 1, the document feeding portion 100 conveys documents set on a tray 1001 in the document feeding portion 100 leftward (in a direction indicated by an arrow) one at a time sequentially from the first page. Further, the document is conveyed rightward from the left over a platen glass 102 via a curved path, and is then discharged onto a discharge tray 112. In this case, a scanner unit 104 is held at a predetermined position. The document is read by passing rightward from the left over the scanner unit 104, i.e., so-called document-flow reading is performed.

The document is irradiated with a lamp 103 of scanner unit 104 when it passes on the platen glass 102. Light reflected from the document is guided into an image sensor 109 via mirrors 105, 106, and 107, and a lens 108.

Alternatively the document conveyed by the document feeding portion 100 is stopped once on the platen glass 102, and the scanner unit 104 is moved rightward from the left so that the document can be read, i.e., so-called document fixed-reading can be performed. When the document is read without using the document feeding portion 100, a user lifts the document feeding portion 100, to set the document on the platen glass 102. In this case, the above-mentioned document fixed-reading is performed.

Image data of the document read by the image sensor 109 is subjected to predetermined image processing and is sent to an exposure control portion 110. The exposure control portion 110 outputs a laser beam corresponding to an image signal. The laser beam is irradiated onto a photosensitive drum 111 while being scanned by a polygonal mirror 110*a*. An electrostatic latent image corresponding to the scanned laser beam is formed on the photosensitive drum 111.

The electrostatic latent image formed on the photosensitive drum 111 is developed by a development device 113, and is visualized as a toner image. On the other hand, a recording sheet is conveyed to a transfer portion 116, constituting an image forming portion together with the photosensitive drum 111 and the development device 113, from any one of cassettes 114, 115, a manual feeding portion 125, and a two-sided conveyance path 124. The transfer portion 116 constitutes an image forming portion together with the photosensitive drum 111 and the development device 113. The visualized toner image is transferred onto the recording sheet in the transfer portion 116. The recording sheet after the transfer is subjected to fixing processing in a fixing portion 177.

The recording sheet, which has passed through the fixing portion 177, is guided into a path 122 once by a switching member 121, is switched back after its trailing end portion has passed through the switching member 121, and is conveyed to a discharge roller 118 by the switching member 121. The discharge roller 118 discharges the recording sheet from the printer portion 300. Thus, on a surface of the recording sheet, the toner image has been formed and the recording sheet can be discharged from the printer portion 300 with its surface facing downward (i.e., face-down). This is referred to as inverted discharge.

Recording sheets are discharged face-down outward from inside the copying machine 1000, as described above, so that they can be collated by page when image forming processing is performed using the document feeding portion 100 and when image forming processing is performed for image data from a computer.

When image forming processing is performed on both surfaces of the recording sheet, the sheet is guided into the discharge roller 118 straight from the fixing portion 177, is switched back immediately after its trailing end portion has passed through the switching member 121, and is guided into the two-sided conveyance path 124 by the switching member 121.

Next, a configuration of the folding processing portion 400 and the finisher 500 will be described with reference to FIGS. 1 and 2.

The folding processing portion 400 includes a conveyance path 131 for accepting a sheet discharged from the printer portion 300 and guiding the sheet toward the finisher 500. Conveyance roller pairs 130 and 133 are provided on the conveyance path 131. A switching member 135 provided in the vicinity of the conveyance roller pair 133 guides the sheet conveyed by the conveyance roller pair 130 toward a folding path 136 or the finisher 500.

When sheet folding processing is performed, the switching member 135 is switched to the folding path 136, to guide the sheet into the folding path 136. The sheet that has been guided into the folding path 136 is conveyed to a folding roller, and is folded in a Z shape. On the other hand, when sheet folding processing is not performed, the switching member 135 is switched to the finisher 500, to directly feed the sheet discharged from the printer portion 300 into the finisher 500 via the conveyance path 131.

As illustrated in FIG. 2, the finisher 500 accepts the sheet from the printer portion 300, which has been conveyed via the folding processing portion 400, in a conveyance path 520, and selectively performs processing, as described below. More specifically, the finisher 500 performs sheet processing such as aligning a plurality of sheets that has been accepted to bind the sheets as one sheet bundle, stapling processing for stapling a trailing end portion of a sheet bundle, sorting processing and non-sorting processing.

A configuration of the saddle stitch binding portion 800 will be described below with reference to FIG. 2. A sheet, which has been switched rightward by a switching member 514 provided halfway in a lower discharge path 522, is sent to the saddle stitch binding portion 800 after passing through a saddle discharge path 523. The sheet is delivered to a saddle inlet roller pair 801, is carried into an accommodating guide 803 in the saddle stitch binding portion 800 after a carry-in port is selected by a switching member 802 that operates by a solenoid depending on its size. The sheet that has been carried into the accommodating guide 803 is conveyed until its leading end portion contacts a movable sheet positioning member 805, by a sliding roller 804.

Staplers 820 opposed to each other with the accommodating guide 803 sandwiched therebetween are provided at a halfway position of the accommodating guide 803. The sheet positioning member 805 is movable depending on a sheet size, and is stopped where its center in a sheet conveyance direction reaches a position where the stapler 820 staples the sheet.

Folding roller pairs 810*a* and 810*b* are provided downstream of the stapler 820, and a projecting member 830 is provided at a position opposing the folding roller pairs 810*a* and 810*b*. A position retreating from the accommodating guide 803 is set as a home position for the projecting member 830, and the projecting member 830 projects toward an accommodated sheet bundle driven by a motor M3, to fold a sheet bundle while pushing the sheet bundle into a nip portion between the folding roller pairs 810*a* and 810*b*. When the sheet bundle stapled by the stapler 820 is folded, the sheet positioning member 805 is lowered by a predetermined distance from its place at the time of stapling processing so that a stapling position of the sheet bundle is the nip portion between the folding roller pairs 810*a* and 810*b*. Thus, the sheet bundle can be folded centering around a position where it is subjected to the stapling processing. The folded sheet bundle is discharged onto a trimmer unit 600 serving as a sheet cutting device via first folding conveyance roller pairs 811*a* and 811*b* and second folding conveyance roller pairs 812*a* and 812*b*.

A fold press unit 860 is provided downstream of the second folding conveyance roller pairs 812*a* and 812*b*. The fold press unit 860 moves in a direction perpendicular to the sheet conveyance direction, to nip a fold of the sheet bundle by a press roller pair 861 to strengthen the fold.

The trimmer unit 600 serving as the sheet cutting device will be described below with reference to FIG. 2. The trimmer unit 600 includes a first conveyance portion 610, a second conveyance portion 620, a trim portion 630, a third conveyance portion 640, a fourth conveyance portion 650, and a discharge unit 660 arranged in this order from an upstream side in the sheet conveyance direction (hereinafter merely referred to as upstream side).

Figure 3:
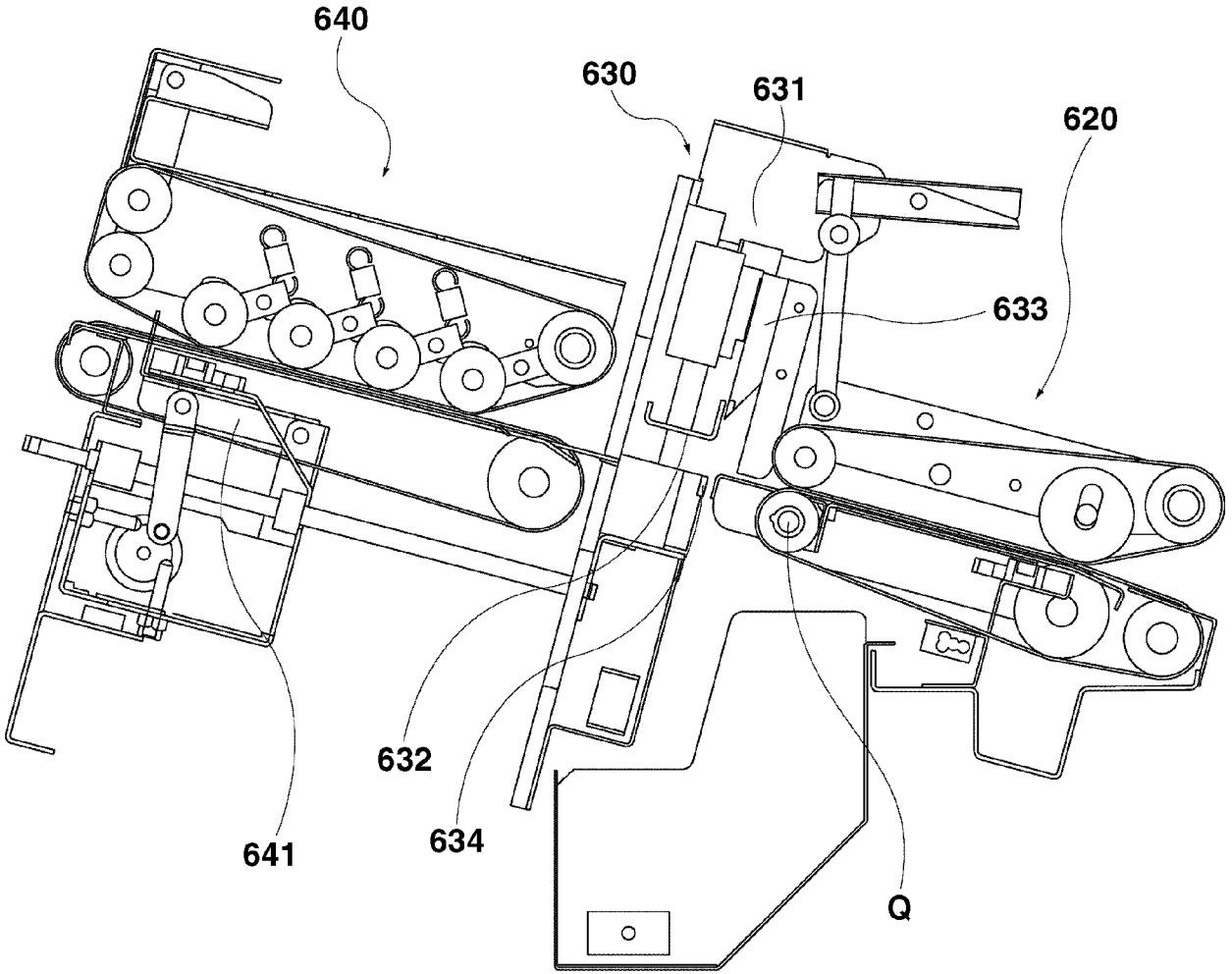
FIG. 3 is a cross-sectional view illustrating the periphery of a trim portion in a trimmer unit.

FIG. 3 is a cross-sectional view illustrating the periphery of the trim portion 630. The trim portion 630 includes a cutter unit 631 arranged in a direction perpendicular to a conveyance path. The cutter unit 631 is driven by a motor (not illustrated), and moves up and down in a direction perpendicular to a conveyance face. A pressing member 632 and an upper blade 633 are arranged in the cutter unit 631. When the cutter unit 631 falls, the pressing member 632 previously abuts on a sheet bundle. The pressing member 632 is biased downward by a spring (not illustrated). Therefore, the cutter unit 631 further falls while holding the sheet bundle so that the upper blade 633 and a fixed lower blade 634 can cut the sheet bundle.

Figure 4:
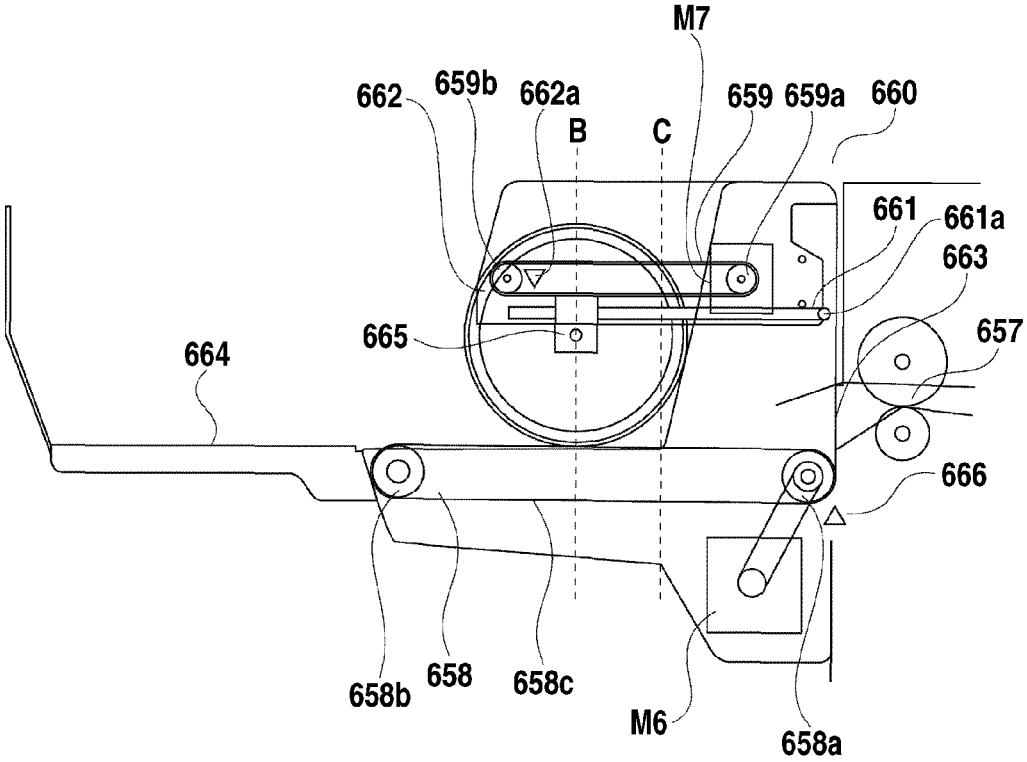
FIG. 4 is an enlarged view of the sheet post-processing apparatus.

FIG. 4 is an enlarged view of a discharge unit 660 serving as a sheet post-processing apparatus according to the first exemplary embodiment, on which a sheet bundle cut by the trim portion 630 is stacked. A discharge roller pair 657 (a discharge portion) for discharging a sheet bundle to the discharge unit 660 is provided in a discharge port 663 in the trimmer unit 600.

The discharge unit 660 includes a conveyer belt 658 (a conveyance portion), forming a part of a stacking face 664 (a stacking portion), which is capable of conveying the sheet bundle discharged by the discharge roller pair 657 downstream in the conveyance direction. The conveyer belt 658 is arranged upstream of the stacking face 664 in the conveyance direction. The conveyance belt 658 is an endless belt having a coefficient of friction at which a sheet bundle can be conveyed. The conveyer belt 658 is stretched rotatably between a pulley 658*a* positioned upstream in the conveyance direction of the discharge unit 660 and arranged in a lower part of the discharge port 663, and a pulley 658*b* arranged downstream of the pulley 658*a*. A conveyer belt motor M6 is connected to the pulley 658*a* via a belt 658*c*. The conveyer belt motor M6 rotates, to rotate the conveyer belt 658 via the pulley 658*a*. The conveyer belt 658 abuts on a lower surface of the sheet bundle, and rotates by the rotation of the conveyer motor M6, to convey the sheet bundle downstream in the sheet conveyance direction.

A moving roller 662 (rotating member) is arranged at a position opposing the conveyer belt 658. The moving roller 662 is supported at its rotation center by a supporting member 665, to press the sheet bundle that abuts on the stacking face 664 and is conveyed by the conveyer belt 658. A rubber member used for a rubber roller or the like for conveying a sheet is arranged on the outer periphery of the moving roller 662. The supporting member 665 is connected to a timing belt 659, is positioned above the conveyer belt 658 and the discharge port 663, and is movable along a rail 661 arranged parallel to the sheet conveyance direction. The timing belt 659 is stretched rotatably between a pulley 659*a* positioned upstream in the conveyance direction of the discharge unit 660 and arranged in an upper part of the discharge port 663, and a pulley 659*b* arranged downstream of the pulley 659*a*. A moving roller motor M7 is connected to the pulley 659*a*. The moving roller motor M7 rotates, to rotate the timing belt 659 via the pulley 659*a*. The timing belt 659 rotates by the rotation of the moving roller motor M7, to move the moving roller 662 upstream and downstream in the sheet conveyance direction via the supporting member 665.

The moving roller 662, together with the rail 661, rotates around a shaft 661*a* arranged upstream of the rail 661. The moving roller 662, the supporting member 665, and the rail 661 constitute a pressing portion.

When thus configured, the moving roller 662 rotates corresponding to the thickness of a sheet bundle to be conveyed even if the thickness of the sheet bundle is changed.

In the first exemplary embodiment, the moving roller 662 is pressed on the sheet bundle under its own weight. However, a spring may be provided to urge the moving roller 662 toward the conveyer belt 658 via the rail 661.

A discharge port sensor 666 for detecting the sheet bundle is arranged at an upstream end in the conveyance direction of the conveyer belt 658. The supporting member 665 includes a flag (not illustrated). A moving roller position sensor 662*a* for detecting a home position of the moving roller 662 is arranged at a downstream end of a moving area of the supporting member 665. The moving roller position sensor 662*a* detects the flag, to detect the home position of the moving roller 662.

Figure 5:
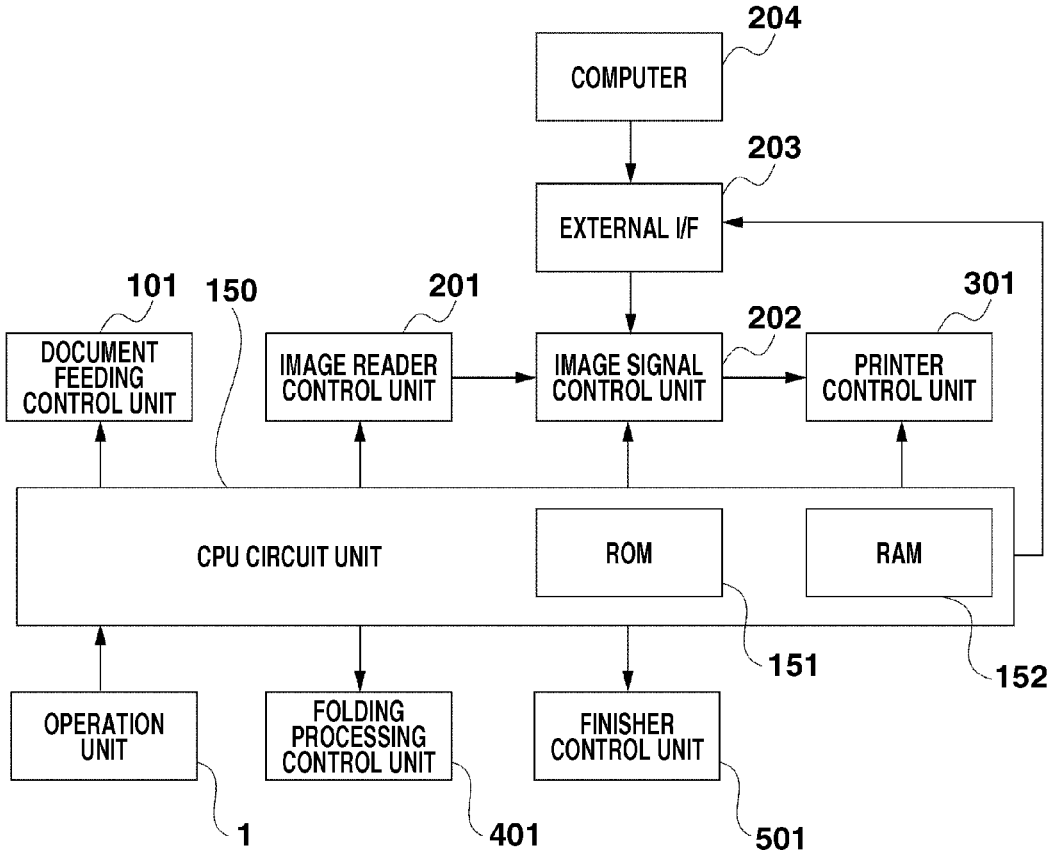
FIG. 5 is a block diagram of a control system in the image forming apparatus.

FIG. 5 is a block diagram of the copying machine 1000. A CPU circuit portion 150 has a central processing unit (CPU) (not illustrated). The CPU circuit portion 150 controls a document feeding control portion 101, an image reader control portion 201, an image signal control portion 202, and a printer control portion 301 according to a control program stored in a read-only memory (ROM) 151 and setting of an operation portion 1. The CPU circuit portion 150 further controls a folding processing control portion 401, a finisher control portion 501, and an external interface (I/F) 203. The document feeding control portion 101, the image reader control portion 201, and the printer control portion 301 respectively control the document feeding portion 100, the image reader portion 200, and the printer portion 300. Further, the folding processing control portion 401 controls the folding processing portion 400, and the finisher control portion 501 controls the finisher 500, the trimmer unit 600, the saddle stitch binding portion 800, and the inserter 900.

The operation unit 1 includes a plurality of keys for setting various types of functions relating to image formation, and a display portion for displaying a setting state. A key signal corresponding to an operation of each of the keys by a user is output to the CPU circuit portion 150 while corresponding information is displayed on the display portion based on a signal from the CPU circuit portion 150.

A random access memory (RAM) 152 is used as an area for temporarily holding control data and a work area for calculation when performing control. The external I/F 203 is an interface between the copying machine 1000 and an external computer 204, and rasterizes print data from the computer 204 into a bit map image and outputs the bit map image to the image signal control portion 202 as image data. An image on a document read by an image sensor (not illustrated) is output from the image reader control portion 201 to the image signal control portion 202. The printer control portion 301 outputs image data from the image signal control portion 202 to an exposure control portion (not illustrated).

Figure 6:
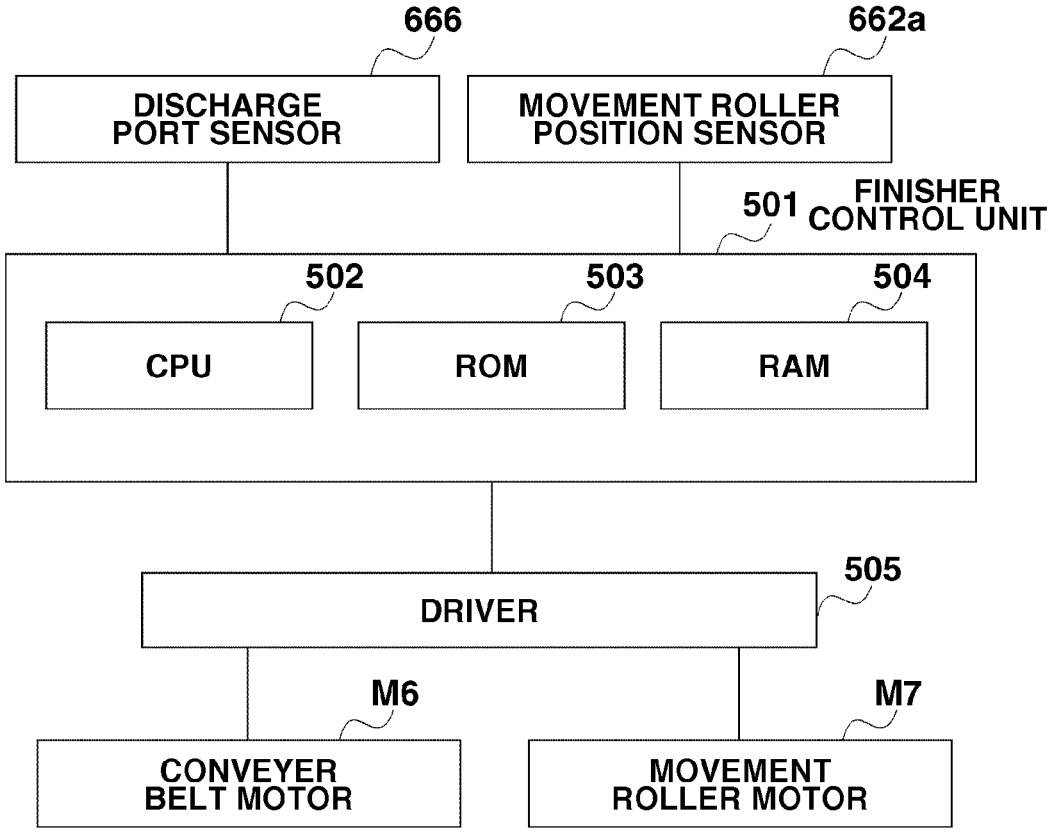
FIG. 6 is a block diagram illustrating a configuration of a finisher control portion.

FIG. 6 is a block diagram illustrating a configuration of the finisher control portion 501. A CPU 502 controls the conveyer belt motor M6 and the moving roller motor M7 via a driver 505 according to a control program stored in a ROM 503. A RAM 504 is used as an area for temporarily holding control data and a work area for calculation when performing control. The finisher control portion 501 is connected to a discharge port sensor 666 and a moving roller position sensor 662*a*, and inputs respective detection results of the sensors.

Respective operations of the portions, together with the flow of a sheet bundle in the trimmer unit 600, will be described below based on the above-mentioned configuration.

Figure 7:
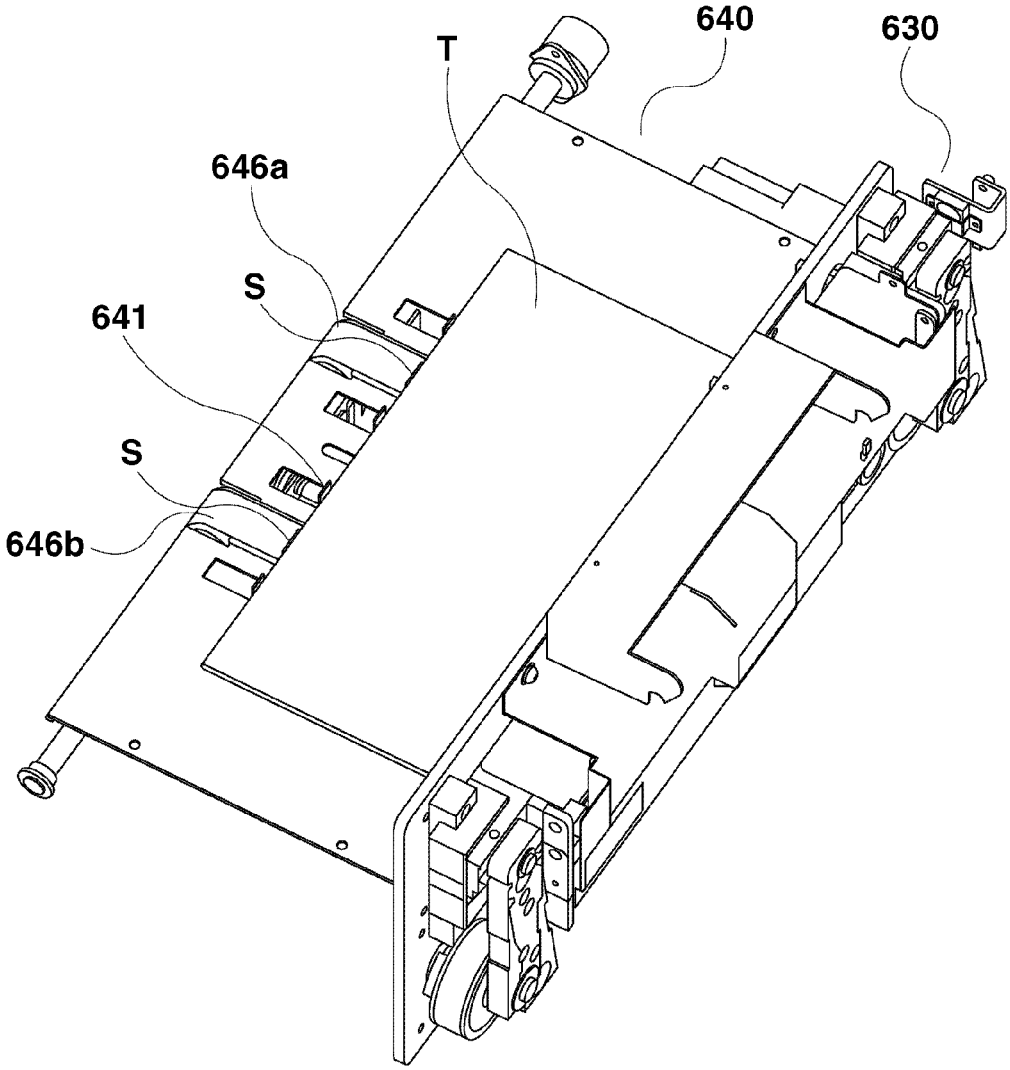
FIG. 7 is a perspective view illustrating the periphery of the trim portion in the trimmer unit.
Figure 8:
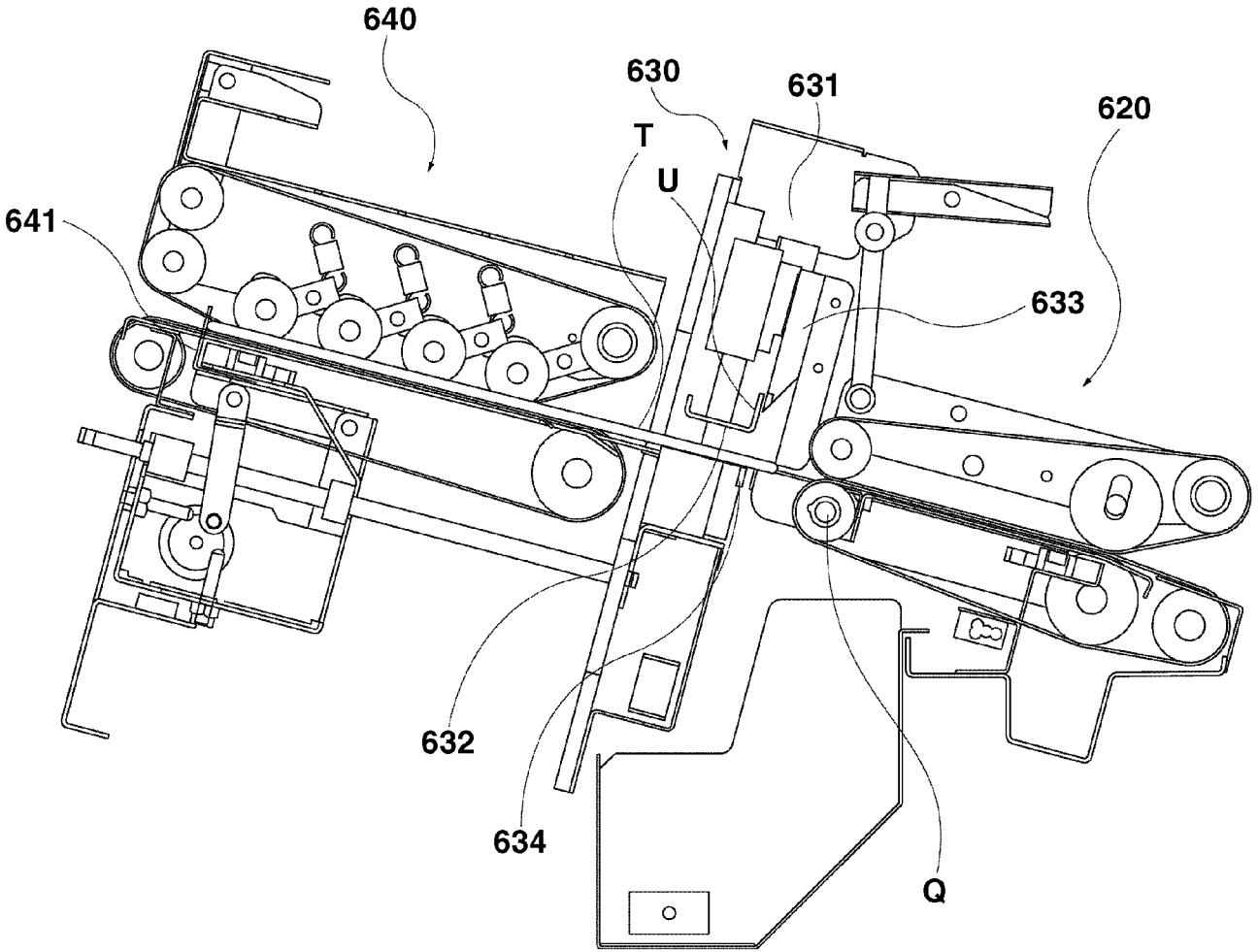
FIG. 8 is a cross-sectional view of a principal part illustrating the periphery of an upper blade in the trimmer unit.

The folding of a sheet bundle is strengthened by the press unit 860 and conveyance of the sheet bundle resumes. The sheet bundle is delivered to the first conveyance portion 610 in the trimmer unit 600 and is conveyed to the third conveyance portion 640 after passing through the second conveyance portion 620 and the trim portion 630. In the third conveyance portion 640, a stopper 641 previously appears on a conveyance path at a suitable position to fit the size of a sheet bundle to be conveyed, and the sheet bundle abuts on the stopper 641 to stop at a predetermined position (see FIGS. 7 and 8). Then, a conveyance belt in the third conveyance portion 640 stops, the cutter unit 631 in the trim portion 630 starts to fall, and the upper blade 633 cuts a trailing end portion of the sheet bundle. At this time, the upper blade 633 cuts the sheet bundle sequentially from the back according to a shape of its blade edge.

The stopper 641 then retreats, to resume conveying the third conveyance portion 640. The sheet bundle is delivered to the fourth conveyance portion 650 arranged downstream side of the third conveyance portion 640.

Figure 9:
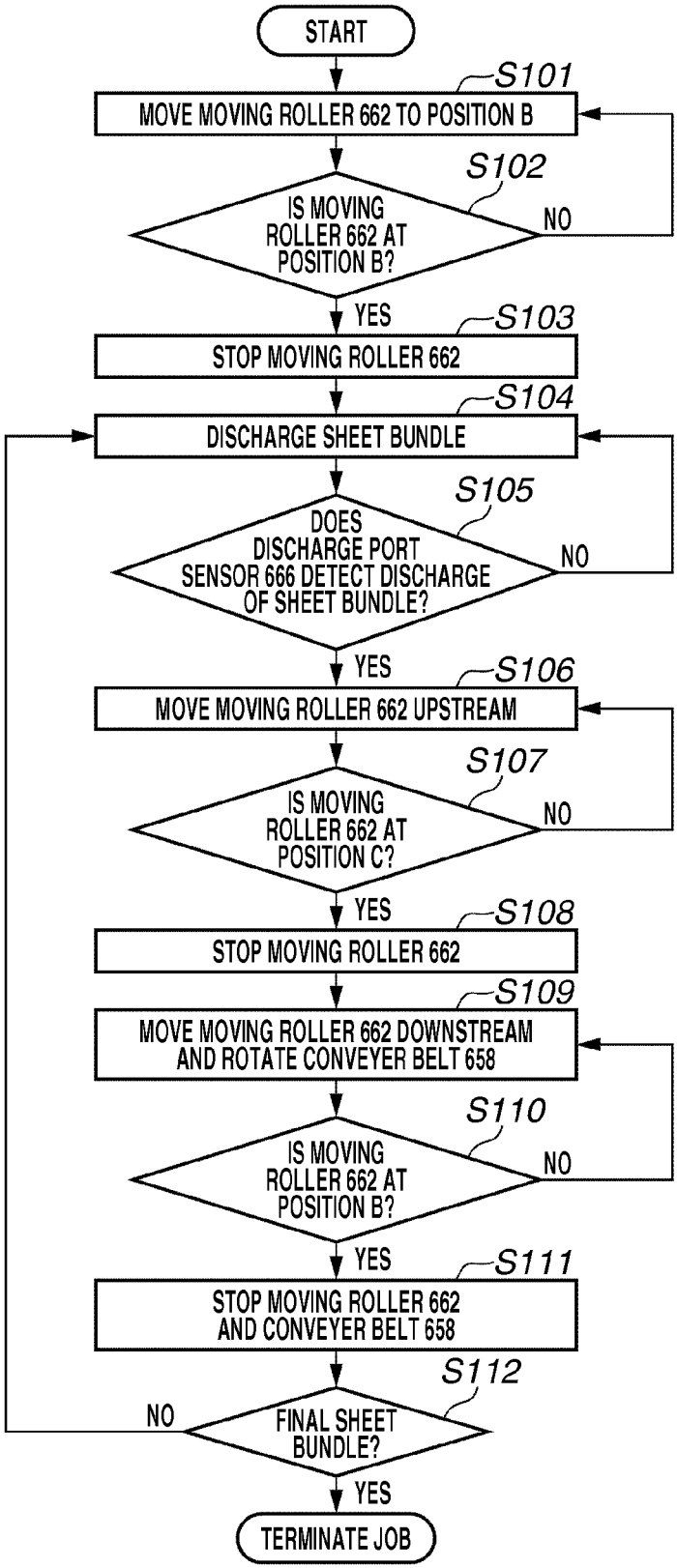
FIG. 9 is a flowchart illustrating operations according to the first exemplary embodiment.

Operations of the moving roller 662 according to the first exemplary embodiment will be described below with reference to a flowchart illustrated in FIG. 9.

Before a sheet bundle is discharged onto the discharge unit 660, e.g., while the saddle stitch binding portion 800 performs saddle stitch binding processing for the sheet bundle, the CPU 502 first starts the moving roller motor M7, to move the moving roller 662 toward a home position. In step S101, the CPU 502 rotates the moving roller motor M7, to move the moving roller 662 to a receiving position B on an upstream side in the conveyance direction of the home position after causing the moving roller position sensor 662*a* to detect the home position. The CPU circuit portion 150 illustrated in FIG. 5 transmits information relating to the length in the conveyance direction of the sheet bundle, to the CPU 502 in the finisher control portion 501.

In step S102, the CPU 502 checks whether the moving roller 662 has moved to the receiving position B. If the moving roller 662 has moved to the receiving position B (YES in step S102), the processing proceeds to step S103. In step S103, the CPU 502 stops the moving roller motor M7, to stop the moving roller 662. If the moving roller 662 has not moved to the receiving position B (NO in step S102), the CPU 502 continues to operate the moving roller motor M7.

In step S104, the CPU 502 causes the fourth conveyance portion 650 to convey the sheet bundle processed by the trim portion 630. In step S105, the CPU 502 then determines whether the discharge port sensor 666 installed at an upstream end in the conveyance direction of the conveyer belt 658 detects that the discharge roller pair 657 has discharged the sheet bundle. If the discharge port sensor 666 detects the discharge of the sheet bundle (YES in step S105), the processing proceeds to step S106. The discharge port sensor 666 can reliably detect that the whole sheet bundle is discharged onto the conveyer belt 658 because the discharge port sensor 666 is arranged at the upstream end in the conveyance direction of the conveyer belt 658. The discharge port sensor 666 detects passage of an upstream end portion (a open end portion) in the conveyance direction of the sheet bundle (YES in step S105). The sheet bundle is discharged onto the conveyer belt 658, as illustrated in FIG. 10A.

Figure 10A:
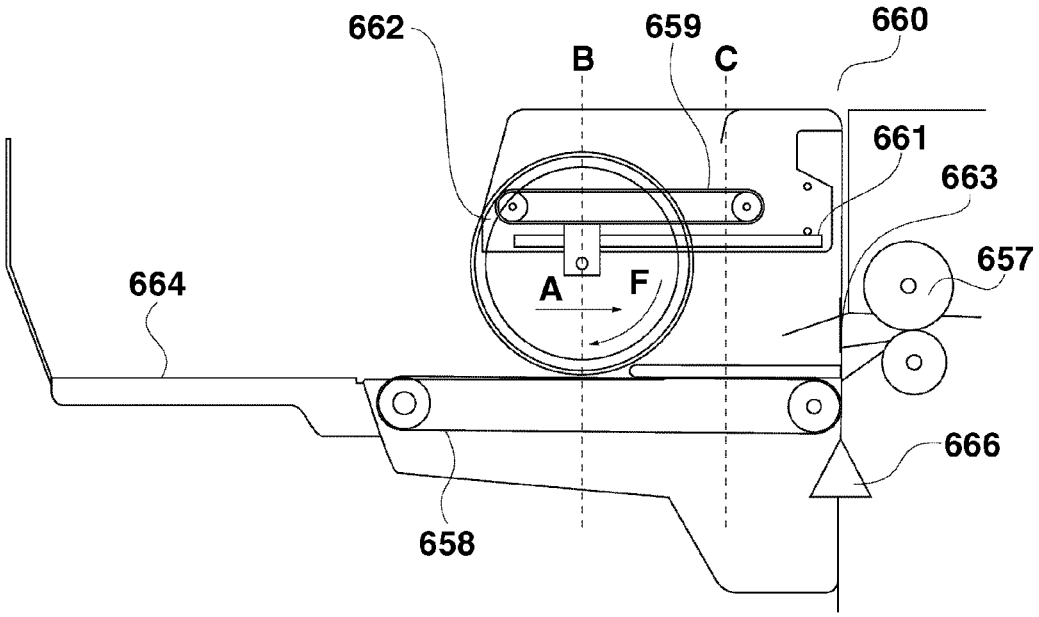
FIGS. 10A and 10B illustrate an operation for discharging sheet bundles.

The receiving position B is set to a position corresponding to the length in the conveyance direction of the sheet bundle discharged onto the conveyer belt 658 so that a downstream end portion (a folded end portion) in the conveyance direction of the discharged sheet bundle does not contact the moving roller 662, as illustrated in FIG. 10A.

The CPU 502 starts the moving roller motor M7 after the sheet bundle is discharged onto the conveyer belt 658.

In step S106, the CPU 502 starts to move the moving roller 662, which has previously been moved to the receiving position B, in an upstream direction opposite to the conveyance direction (in an A direction in FIG. 10A). The moving roller 662 is driven to rotate in an F direction in contact with the conveyer belt 658 or the sheet bundle on the conveyer belt 658 when it moves in the A direction. The moving roller 662 thus moves while rotating so that a downstream end portion in the conveyance direction of the sheet bundle easily thrusts into a nip portion formed between the moving roller 662 and the conveyer belt 658.

The moving roller 662 rotates to run on the downstream end portion (folded end portion) in the conveyance direction of the sheet bundle, which has passed through the nip portion of the discharge roller pair 657, to start pressing the sheet bundle. The moving roller 662 thus rotates to move toward the sheet bundle, which has passed through the nip portion of the discharge roller pair 657, to make it easy to guide the sheet bundle into the nip portion between the moving roller 662 and the conveyer belt 658. Even when a sheet bundle having a large thickness is conveyed by an operation of the moving roller 662, the sheet bundle can be prevented from stopping short of the nip portion between the moving roller 662 and the conveyer belt 658 and from moving downstream in the conveyance direction. A rubber member is arranged on the outer periphery of the moving roller 662. This makes it easier to guide the sheet bundle into the nip portion between the moving roller 662 and the conveyer belt 658 because the outer periphery of the moving roller 662 is deformed in contact with the downstream end portion in the conveyance direction of the sheet bundle.

Figure 10B:
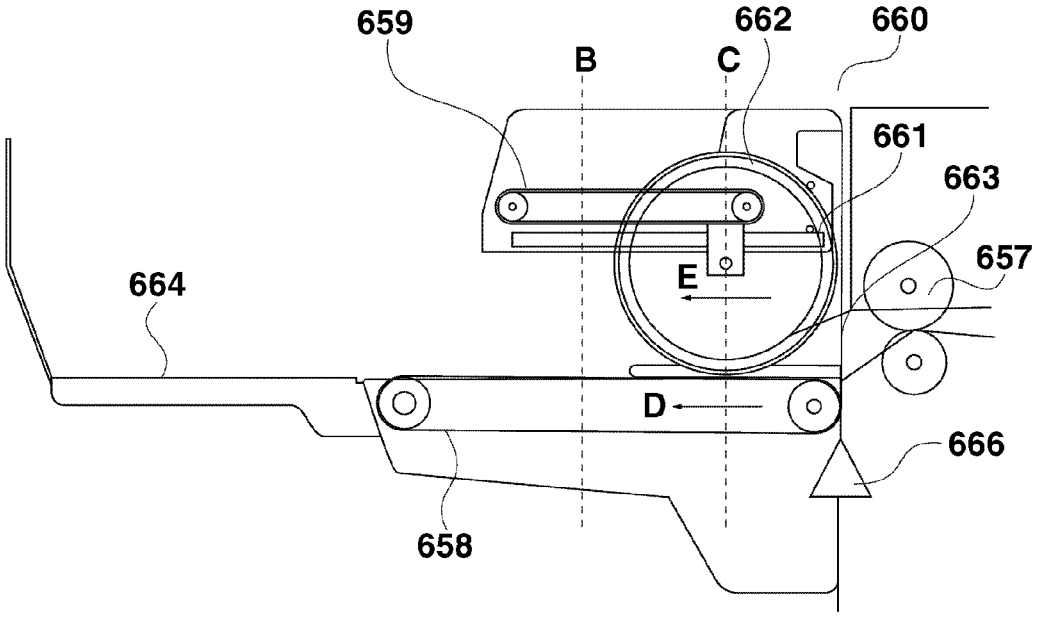

In step S107, the CPU 502 determines whether the moving roller 662 rotates to run on the sheet bundle, to reach a stop position C. If the moving roller 662 reaches the stop position C (YES in step S107), the processing proceeds to step S108. In step S108, the CPU 502 stops the moving roller motor M7, to stop the moving roller 662. FIG. 10B illustrates a state where the moving roller 662 presses the sheet bundle, to stop at the stop position C.

In the present exemplary embodiment, the moving roller motor M7 is a stepping motor. The moving roller motor M7 rotates by a predetermined number of pulses stored in the ROM 503, to move the moving roller 662 from the receiving position B to the stop position C. The moving roller motor M7 also rotates by a predetermined number of pulses stored in the ROM 503, to move the moving roller 662 from the home position to the receiving position B, described above. However, the moving roller motor M7 may be configured with a direct current (DC) motor. The stepping motor may be replaced with DC motor by providing an encoder and a sensor for detecting its amount of rotation.

In step S109, the CPU 502 then moves the moving roller 662, which has been stopped at the stop position C, to a downstream side in the conveyance direction by reversing the moving roller motor M7, and rotates the conveyer belt 658 in a D direction with the conveyer belt motor M6, as illustrated in FIG. 10B. At this time, the CPU 502 makes the moving speed of the moving roller 662 identical to the conveyance speed of the conveyer belt 658. The sheet bundle discharged onto the conveyer belt 658 is moved while being reliably pressed by the moving roller 662 and the conveyer belt 658.

Figure 11A:
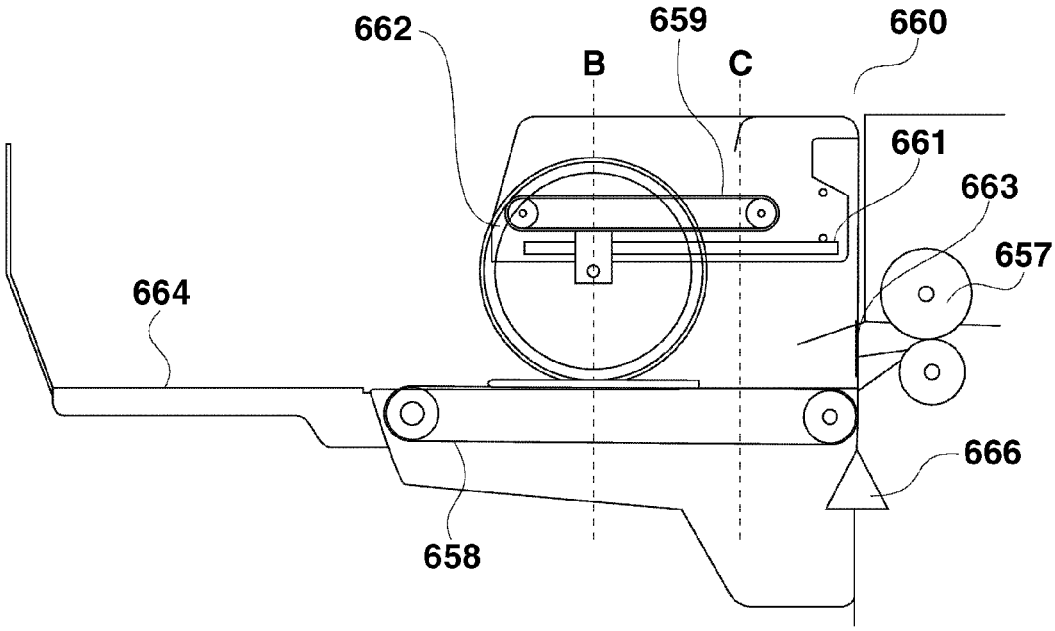
FIGS. 11A and 11B illustrate an operation for discharging sheet bundles.

In step S110, the CPU 502 determines whether the moving roller 662 reaches the receiving position B. If the moving roller 662 reaches the receiving position (YES in step S110), the processing proceeds to step S111. In step S111, the CPU 502 stops the moving roller motor M7 and the conveyer belt motor M6, to stop the moving roller 662 and the conveyer belt 658. FIG. 11A illustrates the states of the sheet bundle and the moving roller 662 at this time. The sheet bundle discharged onto the conveyer belt 658, as illustrated in FIG. 11A, is pressed from its upper surface by the moving roller 662 so that its open end portion is not opened.

Further, a distance between the nip portion of the discharge roller pair 657 and a surface of the conveyer belt 658 is set to a distance at which a sheet bundle to be discharged from the nip portion of the discharge roller pair 657 does not abut on an open end portion of a preceding sheet bundle stacked on the surface of the conveyer belt 658. Similarly, a distance between the receiving position B and the stop position C is set to a distance at which a downstream end portion (a folded end portion) in the conveyance direction of a sheet bundle, which has passed through the nip portion of the discharge roller pair 657, does not abut on a open end portion of a preceding sheet bundle.

Therefore, even if the sheet bundle is conveyed to the conveyer belt 658 the sheet bundle neither enters an open end portion of the preceding sheet bundle nor pushes the preceding sheet bundle outward.

Figure 11B:
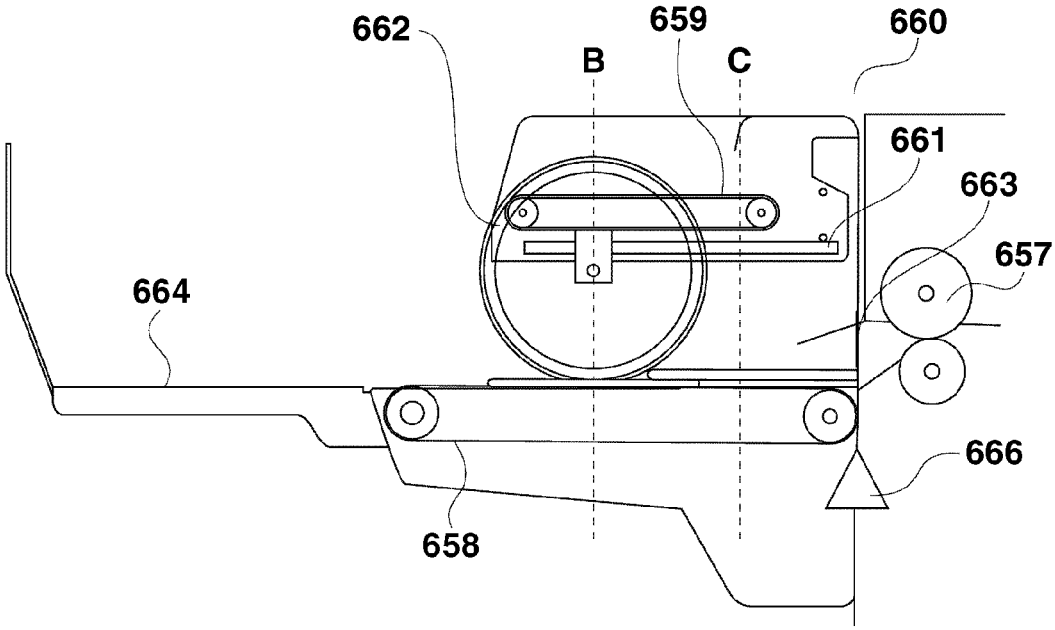

In step S112, the CPU 502 confirms whether the discharged sheet bundle is a final sheet bundle. If the discharged sheet bundle is the final sheet bundle (YES in step S112), the CPU 502 terminates a job. If the discharged sheet bundle is not the final sheet bundle (NO in step S112), the processing returns to step S104. Then the operations in step S104 and the subsequent steps are repeated. FIG. 11B illustrates a state where the discharge port sensor 666 detects, when the discharged sheet bundle is not the final sheet bundle, discharge of a succeeding sheet bundle (YES in step S105). The moving roller 662 waits at the receiving position B set depending on the length in the conveyance direction of a sheet bundle to be discharged onto the conveyer belt 658 so that it does not contact a downstream end portion in the conveyance direction of the sheet bundle while pressing a preceding sheet bundle.

In steps S106 to S111, the CPU 502 controls the conveyer belt 658 and the moving roller 662, as described above. In step S112, the CPU 502 determines whether the discharged sheet bundle is a final sheet bundle. If the discharged sheet bundle is not the final sheet bundle (NO in step S112), the processing returns to step S104. If the discharged sheet bundle is the final sheet bundle (YES in step S112), the CPU 502 terminates a job. The moving roller 662 and the conveyer belt 658 are thus operated so that the discharged sheet bundles are imbricately stacked on the conveyer belt 658.

While the operation for discharging the sheet bundle has been described above, a similar effect is obtained even when not the sheet bundle but one sheet is discharged with its folded end portion positioned on a downstream side in the conveyance direction.

Figure 12:
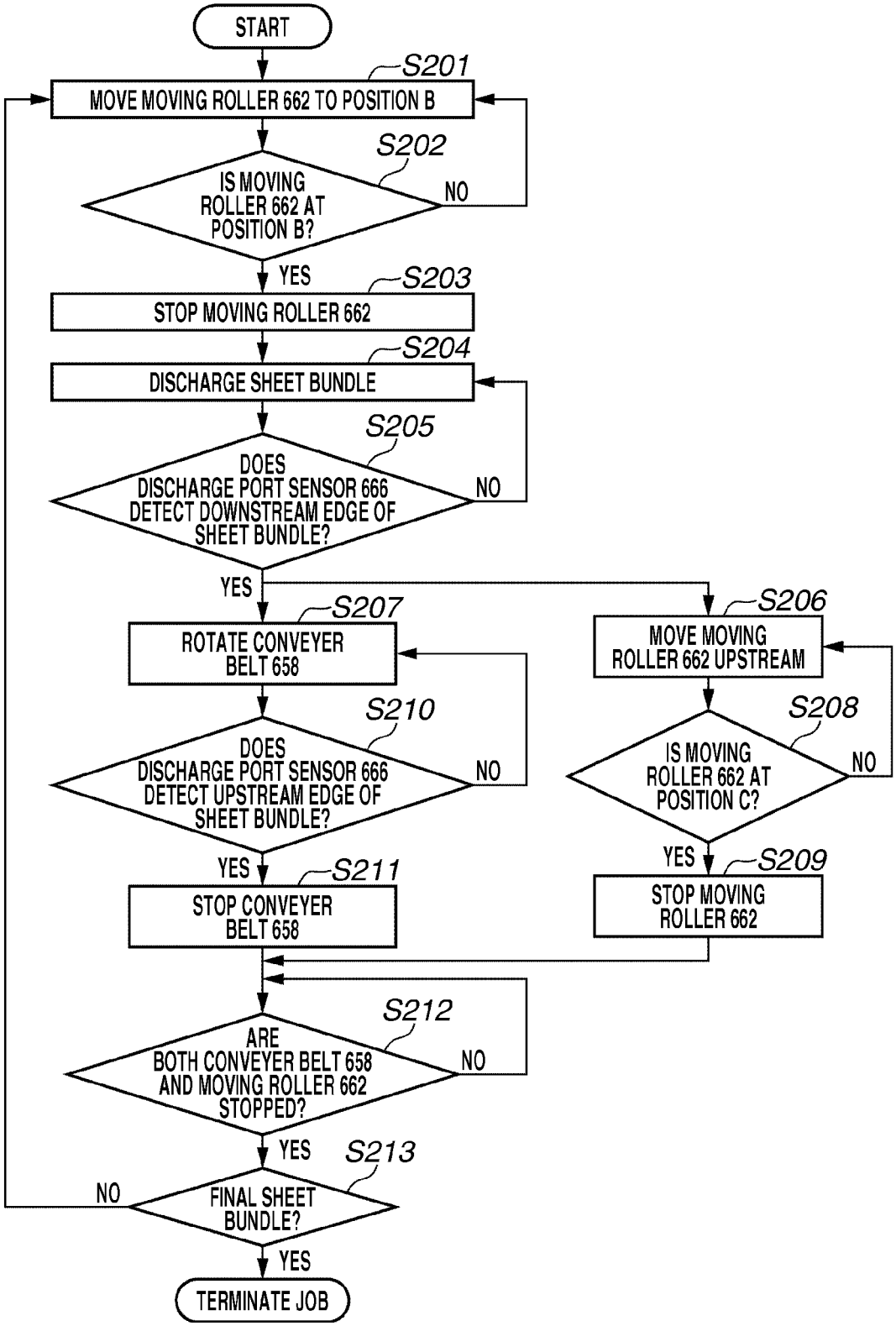
FIG. 12 is a flowchart illustrating operations according to a second exemplary embodiment of the present invention.

A configuration of a sheet post-processing apparatus according to a second exemplary embodiment is similar to the configuration of the sheet post-processing apparatus according to the first exemplary embodiment and hence, the description thereof is omitted. The second exemplary embodiment differs from the first exemplary embodiment in that a conveyer belt 658 operates simultaneously when a moving roller 662 performs a pressing operation. An operation of the moving roller 662 in the second exemplary embodiment will be described with reference to a flowchart illustrated in FIG. 12.

Before a sheet bundle is discharged onto a discharge unit 660, e.g., while a saddle stitch binding portion 800 performs saddle stitch binding processing for a sheet bundle, a CPU 502 first starts a moving roller motor M7, to move a moving roller 662 toward a home position. In step S201, the CPU 502 rotates the moving roller motor M7, to move the moving roller 662 to a receiving position B on an upstream side in a conveyance direction of the home position after causing a moving roller position sensor 662*a* to detect the home position.

In step S202, the CPU 502 checks whether the moving roller 662 has moved to the receiving position B. If the moving roller 662 has moved to the receiving position B (YES in step S202), the processing proceeds to step S203. In step S203, the CPU 502 stops the moving roller motor M7, to stop the moving roller 662. If the moving roller 662 has not moved to the receiving position B (NO in step S202), the CPU 502 continues to operate the moving roller motor M7.

The receiving position B is set to a position corresponding to the length in a conveyance direction of a sheet bundle discharged onto a conveyer belt 658 so that a downstream end portion (a folded end portion) in the conveyance direction of the discharged sheet bundle does not contact the moving roller 662.

In step S204, the CPU 502 causes a fourth conveyance portion 650 to convey a sheet bundle processed by a trim portion 630. In step S205, the CPU 502 then determines whether a discharge port sensor 666 installed at an upstream end of the conveyer belt 658 detects a downstream end portion in the conveyance direction of the sheet bundle discharged by the discharge roller pair 657. If the discharge port sensor 666 detects the downstream end portion in the conveyance direction of the sheet bundle (YES in step S205), the processing proceeds to step S206. The CPU 502 starts the moving roller motor M7 after a predetermined period of time.

Figure 13A:
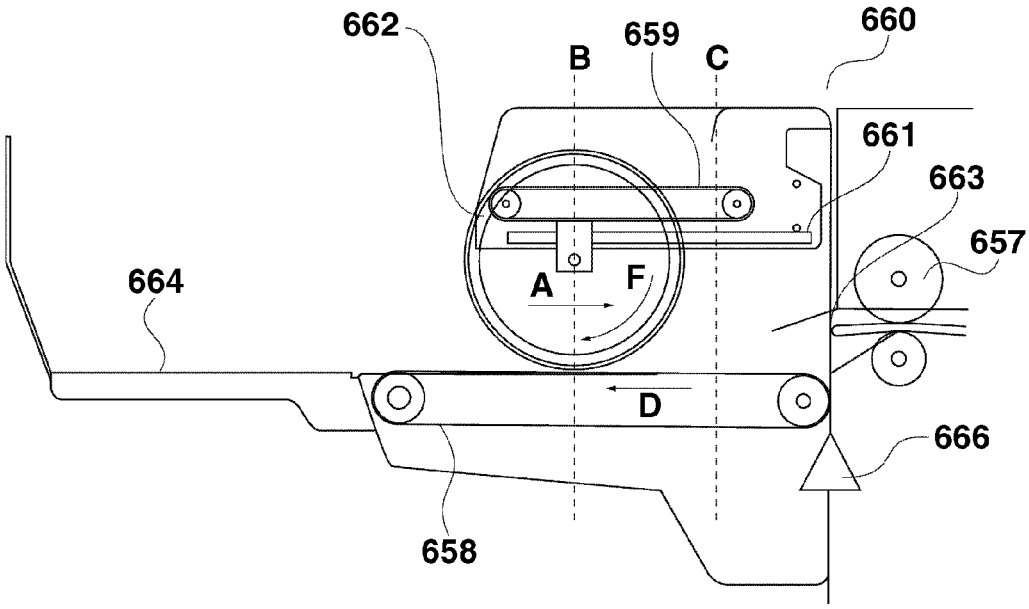
FIGS. 13A and 13B illustrate an operation for discharging sheet bundles.

In step S206, the CPU 502 starts to move the moving roller 662, which has previously been moved to the receiving position B, in an upstream side direction along the conveyance direction (in an A direction in FIG. 13A). The moving roller 662 is driven to rotate in an F direction in contact with the conveyer belt 658 or the sheet bundle on the conveyer belt 658 when it moves in the A direction. The moving roller 662 moves while rotating so that the downstream end portion in the conveyance direction of the sheet bundle easily thrusts into a nip portion formed between the moving roller 662 and the conveyer belt 658.

In step S207, the CPU 502 starts a conveyer belt motor M6, to rotate the conveyer belt 658 in a D direction simultaneously with the start of the moving roller motor M7. The conveyer belt, together with the discharge roller pair 657, conveys the sheet bundle to a downstream side in the conveyance direction. The second exemplary embodiment differs from the first exemplary embodiment in that a pressing operation by the moving roller 662 and a conveyance operation by the discharge roller pair 657 and the conveyer belt 658 are simultaneously performed.

The moving roller 662 rotates and moves to run on the downstream end portion (folded end portion) in the conveyance direction of the sheet bundle, which has passed through a nip portion of the discharge roller pair 657, to start pressing the sheet bundle. The moving roller 662 thus moves while rotating toward the sheet bundle, which has passed through the nip portion of the discharge roller pair 657, to make it easier to guide the sheet bundle to the nip portion between the moving roller 662 and the conveyer belt 658. Even when a sheet bundle having a large thickness is conveyed by an operation of the moving roller 662, the sheet bundle can be prevented from stopping short of the nip portion between the moving roller 662 and the conveyer belt 658 and from moving to a downstream side in the conveyance direction. A rubber member is arranged on the outer periphery of the moving roller 662, to make it easier to guide the sheet into the nip portion between the moving roller 662 and the conveyer belt 658 by deformation of the outer periphery of the moving roller 662 relative to the downstream end portion in the conveyance direction of the sheet bundle.

If the sheet bundle is conveyed at high speed when the moving roller 662 moves, a load applied when the sheet bundle thrusts into the nip portion between the moving roller 662 and the conveyer belt 658 is liable to increase. By simultaneously moving the moving roller 662 and the conveyer belt 658 and concurrently performing an operation for pressing the sheet bundle by the moving roller 662 and an operation for discharging the sheet bundle by the conveyer belt 658, a period of time can be shortened even if the moving speed of the moving roller 662 is low. The moving roller starts to move earlier so that the moving speed of the moving roller 662 can be kept lower. Therefore, the load becomes lower so that the sheet bundle easily thrusts into the nip portion. From such a reason, the moving speed of the moving roller 662 is set lower than the moving speed of the moving roller 662 in the first exemplary embodiment in which the moving roller 662 starts to move after the sheet bundle is discharged onto the conveyer belt 658. More specifically, in the first and second exemplary embodiments, a relative speed between the moving roller 662 and the sheet bundle when the sheet bundle is guided into the nip portion between the moving roller 662 and the conveyer belt 658 is constant. Therefore, a load applied when the sheet bundle thrusts into the nip portion is kept low.

Figure 13B:
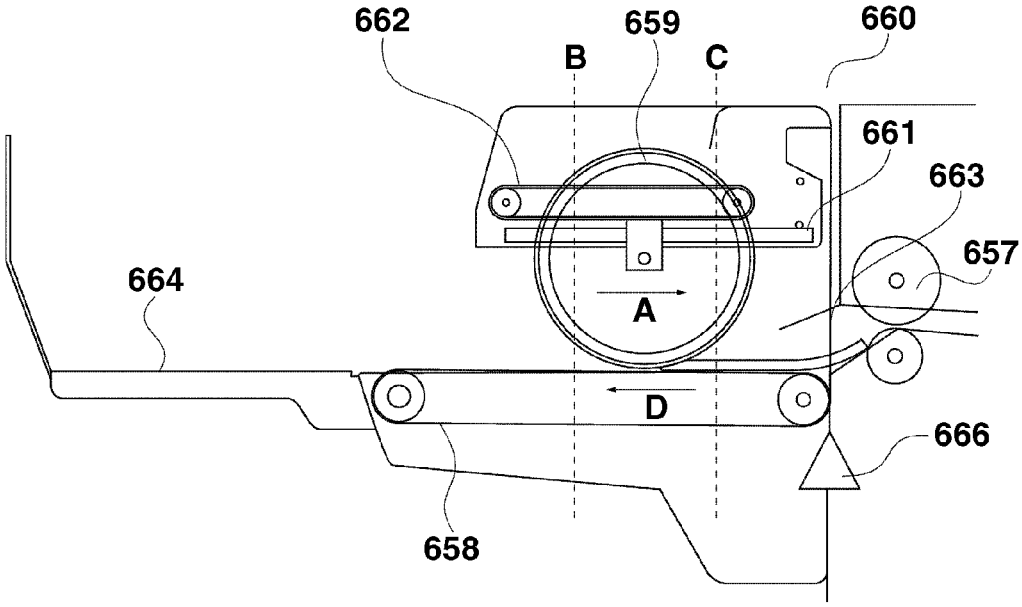

In step S208, the CPU 502 determines whether the moving roller 662 rotates to run on the sheet bundle (see FIG. 13B), to reach a stop position C. If the moving roller 662 reaches the stop position (YES in step S208), the processing proceeds to step S209. In step S209, the CPU 502 stops the moving roller motor M7, to stop the moving roller 662.

In the present exemplary embodiment, the moving roller motor M7 is a stepping motor. The moving roller motor M7 rotates by a predetermined number of pulses stored in the ROM 503, to move the moving roller 662 from the receiving position B to the stop position C. The moving roller motor M7 also rotates by a predetermined number of pulses stored in the ROM 503, to move the moving roller 662 from the home position to the receiving position B, as described above. However, the moving roller motor M7 may be configured with a DC motor. The stepping motor may be replaced with a DC motor by providing an encoder and a sensor for detecting its amount of rotation.

Figure 14A:
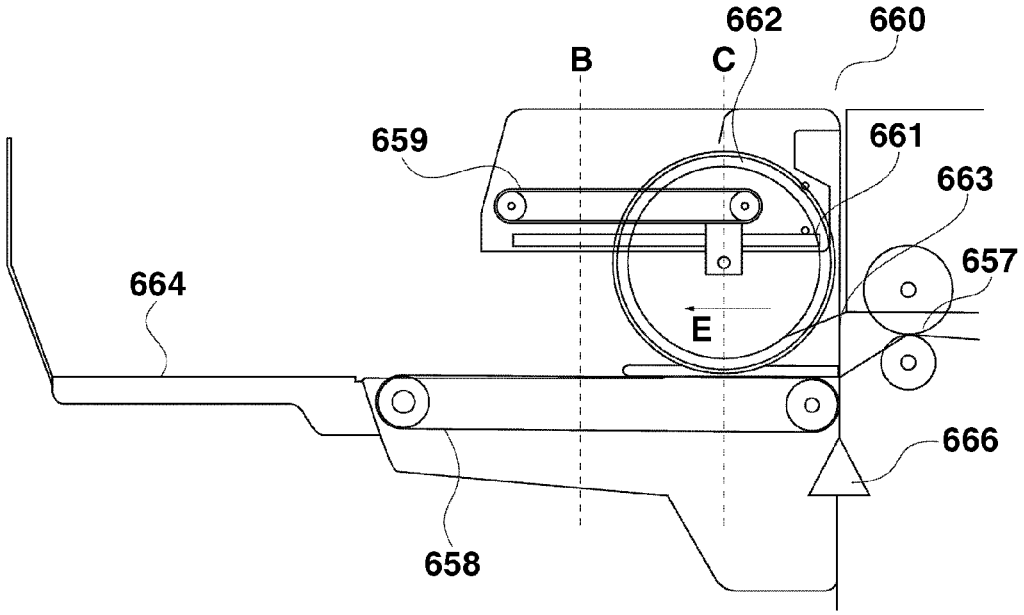
FIGS. 14A and 14B illustrate an operation for discharging sheet bundles.

In step S210, the CPU 502 determines whether the discharge port sensor 666 detects passage of an upstream end portion (open end portion) in the conveyance direction of the sheet bundle. If the discharge port sensor 666 detects the passage of the upstream end portion in the conveyance direction of the sheet bundle (YES in step S210), the processing proceeds to step S211. In step S211, the CPU 502 stops the conveyer belt 658. FIG. 14A illustrates a state at this time. Since the discharge port sensor 666 is arranged at an upstream end portion in the conveyance direction of the conveyer belt 658, it can be reliably detected that the whole sheet bundle is discharged onto the conveyer belt 658.

In step S212, the CPU 502 checks whether both the moving roller 662 and the conveyer belt 658 are stopped. If both the moving roller 662 and the conveyer belt 658 are stopped (YES in step S212), the processing proceeds to step S213. In step S213, the CPU 502 confirms whether the discharged sheet bundle is a final sheet bundle. If the discharged sheet bundle is the final sheet bundle (YES in step S213), the CPU 502 terminates a job. If the discharged sheet bundle is not the final sheet bundle (NO in step S213), the processing returns to step S201. The operations in step S201 and the subsequent steps are repeated.

A sheet bundle discharging operation performed when one sheet bundle is discharged, as illustrated in FIG. 14A, and then a succeeding sheet bundle is discharged (NO in step S213) will be described in detail.

Figure 14B:
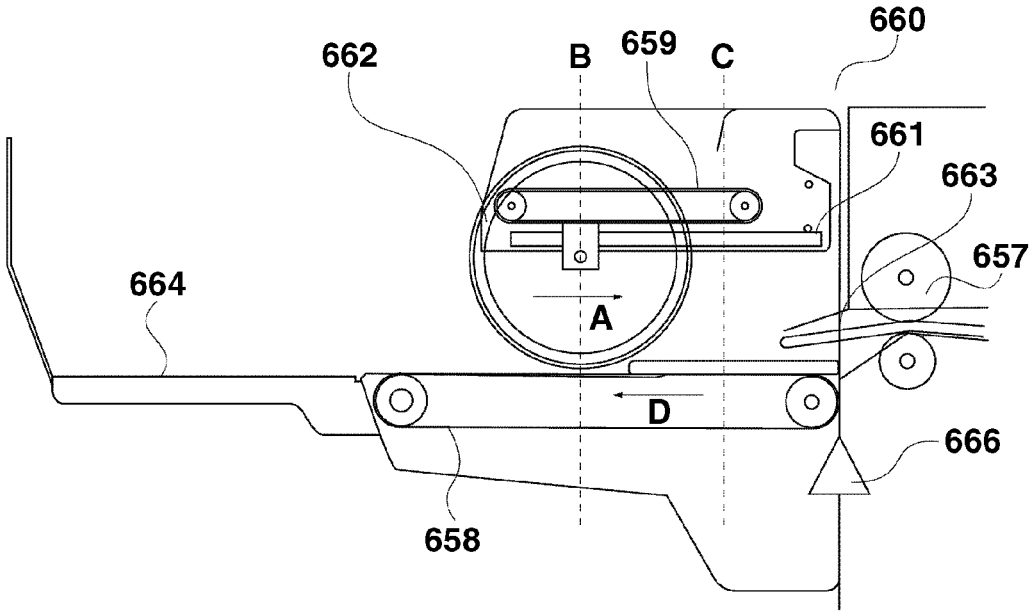

In step S201, the CPU 502 starts to move, when a sheet bundle is discharged, the moving roller 662 in a downstream side direction along the conveyance direction (in an E direction in FIG. 14A) from a position where the moving roller 662 stops after a preceding sheet bundle is discharged to the receiving position B. A detailed position of the receiving position B (a rotation center of the moving roller 662) is set on a downstream side of a downstream end portion in the conveyance direction of the preceding sheet bundle that has already been discharged onto the conveyer belt 658, as illustrated in FIG. 14B. When the preceding sheet bundle is discharged, the moving roller 662 is positioned at the receiving position B (FIG. 13A). While description of the detailed position of the receiving position B illustrated in FIG. 13A is omitted in description of the sheet bundle discharging operation, the receiving position B illustrated in FIG. 13A and the receiving position B illustrated in FIG. 14B are the same.

If the discharge port sensor 666 detects the downstream end portion in the conveyance direction of the sheet bundle (YES in step S205), the processing proceeds to step S206. In step S206, the CPU 502 starts the moving roller motor M7, to rotate the timing belt 659 after a predetermined period of time. "After a predetermined period of time" means "after a downstream end portion in the conveyance direction of a sheet bundle overlaps with the top of an upstream end portion in predetermined length in the conveyance direction of a preceding sheet bundle, as illustrated in FIG. 14B.

The moving roller 662 does not press the preceding sheet bundle before the moving roller motor M7 is started, as illustrated in FIG. 14B. Therefore, an open end portion of the preceding sheet bundle may slightly be opened. Thus, a distance between the nip portion of the discharge roller pair 657 and the conveyer belt 658 is set to a distance at which the sheet bundle does not abut on the open end portion of the preceding sheet bundle discharged onto the conveyer belt 658 even while the preceding sheet bundle is slightly opened.

In step S207, the CPU 502 starts the conveyer belt motor M6, to move the conveyer belt 658 in the D direction simultaneously with the start of the moving roller motor M7. The CPU 502 conveys the succeeding sheet bundle, together with the discharge roller pair 657, to a downstream side. Simultaneously, the preceding sheet bundle is conveyed to the downstream side in the conveyance direction as the conveyer belt 658 moves.

In steps S208 to S212, the CPU 502 controls the conveyer belt 658 and the moving roller 662, as described above. In step S213, the CPU 502 determines whether the discharged sheet bundle is a final sheet bundle. If the discharged sheet bundle is not the final sheet bundle (NO in step S213), the processing returns to step S201. If the discharged sheet bundle is the final sheet bundle (YES in step S213), the CPU 502 terminates a job.

Figure 15:
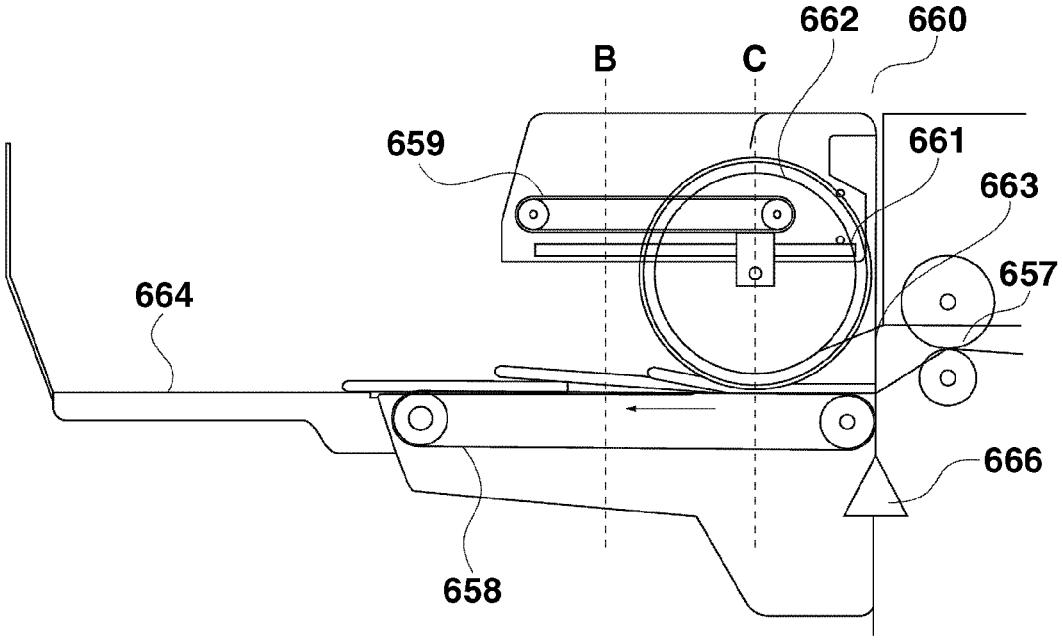
FIG. 15 illustrates an operation for discharging sheet bundles.

FIG. 15 illustrates a state where three sheet bundles are discharged onto the conveyer belt 658.

The sheet bundles are imbricately stacked, as Illustrated in FIG. 15, so that the sheet bundle can be prevented from entering an open end portion on an upstream side in the conveyance direction of the preceding sheet bundle.

The second exemplary embodiment differs from the first exemplary embodiment in that the moving roller 662 starts to move while the conveyer belt 658 is conveying the sheet bundle. Thus, the moving roller 662 prepares to receive the succeeding sheet bundle earlier than that in the first exemplary embodiment so that discharge productivity can be improved.

While the operation for discharging the sheet bundle has been described above, a similar effect is obtained even when not the sheet bundle but one sheet is discharged with its folded end portion positioned on a downstream side in the conveyance direction.

In the above-mentioned first and second exemplary embodiments, the timing belt 659 or the like is attached as a moving portion for moving the moving roller 662 between the receiving position B and the conveyance position C. However, the moving portion for moving the moving roller 662 is not limited to this.

Figure 16:
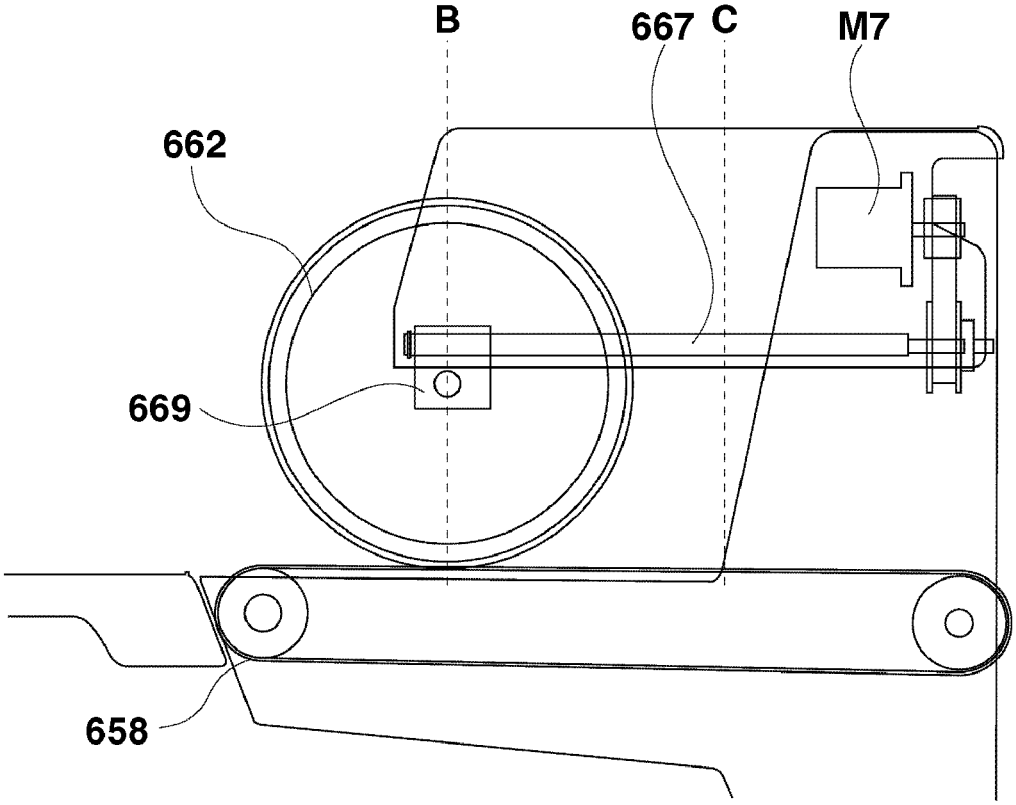
FIG. 16 illustrates another moving portion in the present invention.
Figure 17:
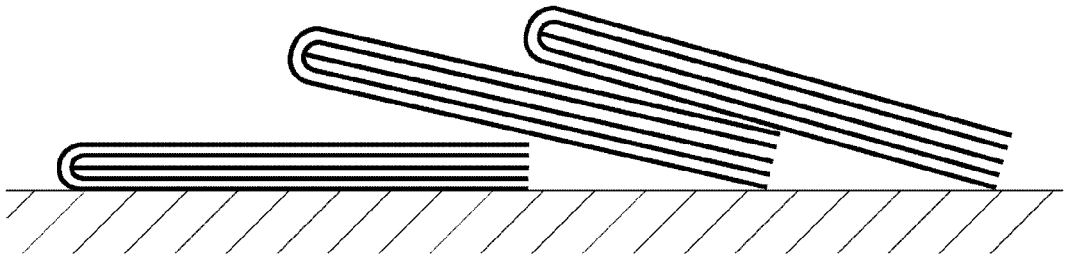
FIG. 17 illustrates sheet bundles imbricately stacked.
Figure 18A:
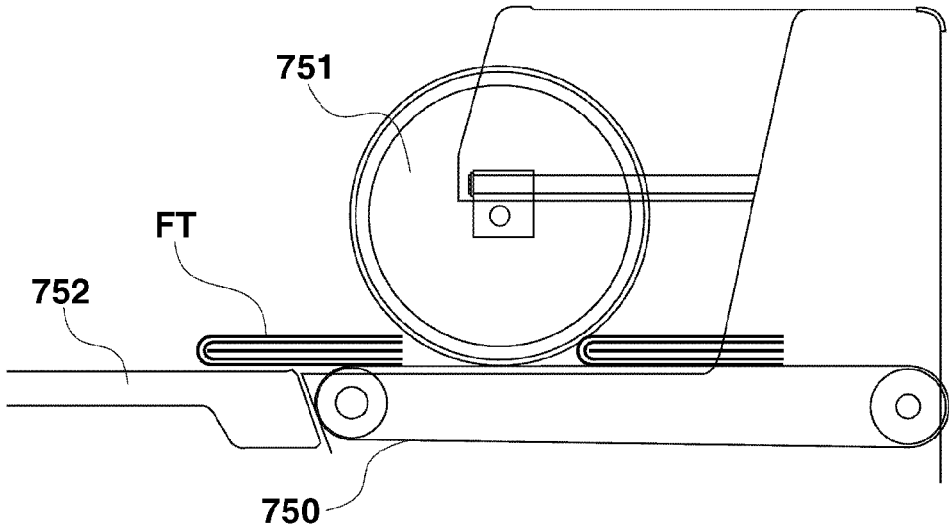
FIGS. 18A and 18B are cross-sectional views of a conventional sheet post-processing apparatus.
Figure 18B:
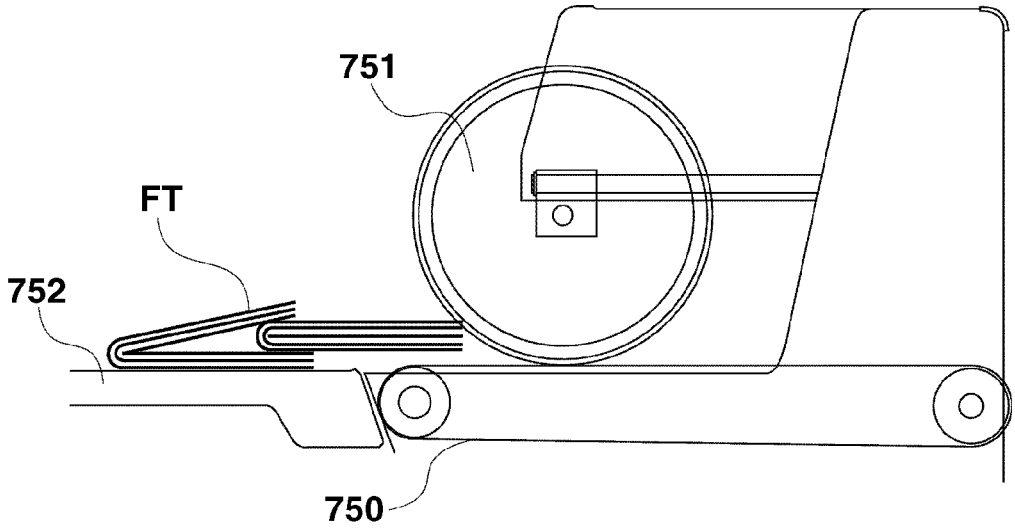

For example, a feed screw 667 may be provided as the moving portion for moving the moving roller 662, as illustrated in FIG. 16. The feed screw 667, which has been driven by a moving roller motor M7, rotates so that a bearing block 669 having a tapped hole moves parallel to a conveyance direction. Thus, the moving roller 662 having a rotation center supported by the bearing block 669 moves between the receiving position B and the conveyance position C. The others are similar to those in the above-mentioned configuration.

While a copying machine is described as an example of the image forming apparatus in the above-mentioned exemplary embodiments, the present invention is not limited to this. Other image forming apparatuses such as a printer and a facsimile or image forming apparatuses such as a multi-functional peripheral equipment having a combination of the above functions may be used. A similar effect can be obtained by applying the present invention to sheet post-processing apparatuses used for the image forming apparatuses.

While the sheet post-processing apparatus that is removably mounted on the image forming apparatus has been described as an example in the first and second exemplary embodiments, the present invention is not limited to this. For example, a sheet post-processing apparatus integrally included in the image forming apparatus may be used. If the present invention is applied to the sheet post-processing apparatus, a similar effect can be obtained.

As shown in the present invention, a pressing portion for pressing a sheet moves in a direction opposite to a sheet conveyance direction, and moves from a position where a sheet discharged to a stacking portion is not pressed, to a position where the sheet is pressed so that the sheet can be prevented from stopping conveying of the sheet by pressing portion.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-281002 filed Dec. 10, 2009, which is hereby incorporated by reference herein in its entirety.

What is claimed is:

1. A sheet post-processing apparatus, comprising:

a conveyance portion configured to convey a sheet;

a transport portion configured to abut on a lower surface of the sheet conveyed by the conveyance portion, to transport the sheet downstream in a sheet conveyance direction of the conveyance portion;

a pressing portion arranged at a position opposing the transport portion, configured to press an upper surface of the sheet conveyed by the conveyance portion;

a moving portion configured to move the pressing portion in the sheet conveyance direction of the conveyance portion and in a direction opposite to the sheet conveyance direction; and a controller configured to control the moving portion, so that the moving portion moves the pressing portion in the opposite direction from a first position to a second position, disposed upstream of the first position in the sheet conveyance direction, to press the sheet conveyed by the conveyance portion, and so that the moving portion moves the pressing portion in the sheet conveyance direction from the second position to the first position while the pressing portion presses the sheet being transported by the transport portion.

2. The sheet post-processing apparatus according to claim 1, wherein the pressing portion includes a rotating member, and the rotating member rotates in contact with the sheet when the pressing portion moves to the second position.

3. The sheet post-processing apparatus according to claim 1, wherein the transport portion transports the sheet toward the pressing portion when the pressing portion moves from the first position to the second position.

4. The sheet post-processing apparatus according to claim 1, further comprising:

a folding processing portion configured to fold a sheet into two, wherein the conveyance portion conveys a sheet folded by the folding processing portion, and the pressing portion presses the folded sheet conveyed with their folded end portion positioned downstream in the conveyance direction.

5. The sheet post-processing apparatus, comprising:

a conveyance portion configured to convey a sheet;

a transport portion configured to abut on a lower surface of the sheet conveyed by the conveyance portion, to transport the sheet downstream in a sheet conveyance direction of the conveyance portion;

a pressing portion arranged at a position opposing the transport portion, configured to press an upper surface of the sheet conveyed by the conveyance portion;

a moving portion configured to move the pressing portion in the sheet conveyance direction of the conveyance portion and in a direction opposite to the sheet conveyance direction; and a controller configured to control the transport portion, so that the moving portion moves the pressing portion in the opposite direction from a first position where a preceding sheet is pressed to a second position, disposed upstream of the first position in the sheet conveyance direction, to press a succeeding sheet conveyed by the conveyance portion, and so that the transport portion transports the preceding sheet and the succeeding sheet in the sheet conveyance direction while the pressing portion presses the succeeding sheet whose downstream end portion in the sheet conveyance direction overlapping with an upstream end portion of the preceding sheet.

6. The sheet post-processing apparatus according to claim 5, wherein the pressing portion includes a rotating member, and the rotating member rotates in contact with the sheet when the pressing portion moves to the second position.

7. The sheet post-processing apparatus according to claim 5, wherein the transport portion transports the succeeding sheet toward the pressing portion when the pressing portion moves from the first position to the second position.

8. The sheet post-processing apparatus according to claim 5, further comprising:

a folding processing portion configured to fold a sheet into two, wherein the conveyance portion conveys a sheet folded by the folding processing portion, and the pressing portion presses the folded sheet conveyed with their folded end portion positioned downstream in the conveyance direction.

9. An image forming apparatus comprising:

an image forming portion configured to form an image on a sheet; and a sheet post-processing apparatus for post-processing the sheet having the image formed thereon comprising:

a conveyance portion configured to convey a sheet having a folded end portion;

a transport portion configured to abut on a lower surface of the sheet conveyed by the conveyance portion, to transport the sheet downstream in a sheet conveyance direction of the conveyance portion;

a pressing portion arranged at a position opposing the transport portion, configured to press an upper surface of the sheet conveyed by the conveyance portion;

a moving portion configured to move the pressing portion in the sheet conveyance direction of the conveyance portion and in a direction opposite to the sheet conveyance direction; and a controller configured to control the moving portion, so that the moving portion moves the pressing portion in the opposite direction from a first position to a second position, disposed upstream of the first position in the sheet conveyance direction, to press the sheet conveyed by the conveyance portion, and so that the moving portion moves the pressing portion in the sheet conveyance direction from the second position to the first position while the pressing portion presses the sheet being transported by the transport portion.

10. An image forming apparatus comprising:

an image forming portion configured to form an image on a sheet; and a sheet post-processing apparatus for post-processing the sheet having the image formed thereon comprising:

a conveyance portion configured to convey a sheet having a folded end portion;

a transport portion configured to abut on a lower surface of the sheet conveyed by the conveyance portion, to transport the sheet downstream in a sheet conveyance direction of the conveyance portion;

a pressing portion arranged at a position opposing the transport portion, configured to press an upper surface of the sheet conveyed by the conveyance portion;

a moving portion configured to move the pressing portion in the sheet conveyance direction of the conveyance portion and in a direction opposite to the sheet conveyance direction; and a controller configured to control the moving portion, so that the moving portion moves the pressing portion in the opposite direction from a first position where a preceding sheet is pressed to a second position, disposed upstream of the first position in the sheet conveyance direction, to press a succeeding sheet conveyed by the conveyance portion, and so that the transport portion transports the preceding sheet and the succeeding sheet in the sheet conveyance direction while the pressing portion presses the succeeding sheet whose downstream end portion in the sheet conveyance direction overlapping with an upstream end portion of the preceding sheet.

* * * * *